US006786757B2

(12) United States Patent
Pocrass

(10) Patent No.: US 6,786,757 B2
(45) Date of Patent: Sep. 7, 2004

(54) RJ TYPE COAXIAL CABLE CONNECTOR

(76) Inventor: Alan L. Pocrass, 41 Golden Glen, Simi Valley, CA (US) 93065

( * ) Notice: Subject to any disclaimer, the term of this patent is extended or adjusted under 35 U.S.C. 154(b) by 0 days.

(21) Appl. No.: 10/398,526

(22) PCT Filed: Mar. 12, 2001

(86) PCT No.: PCT/US01/07791

§ 371 (c)(1),
(2), (4) Date: Apr. 8, 2003

(87) PCT Pub. No.: WO01/69728

PCT Pub. Date: Sep. 20, 2001

(65) Prior Publication Data

US 2004/0033721 A1 Feb. 19, 2004

(30) Foreign Application Priority Data

Mar. 14, 2000 (US) ..... 09524934
Jan. 23, 2001 (US) ..... 60263484

(51) Int. Cl.[7] ..... H01R 11/20
(52) U.S. Cl. ..... 439/418; 439/578
(58) Field of Search ..... 439/418, 344, 439/578, 581

(56) References Cited

U.S. PATENT DOCUMENTS 3,523,269 A 8/1970 Witek, Jr. et al.
4,379,606 A 4/1983 Clark et al.
4,457,570 A 7/1984 Bogese, II
4,506,944 A * 3/1985 Brennan et al. ..... 439/607
4,648,682 A 3/1987 Tubbs
4,978,317 A 12/1990 Pocrass
5,240,436 A 8/1993 Bradley et al.
5,605,473 A 2/1997 Kishon
5,726,851 A 3/1998 Knapp
6,042,422 A 3/2000 Youtsey
6,290,538 B1 * 9/2001 Pocrass ..... 439/578
6,409,544 B1 * 6/2002 Wu ..... 439/608
6,520,794 B2 * 2/2003 Liao ..... 439/418
6,592,397 B2 * 7/2003 Pocrass ..... 439/418

* cited by examiner

*Primary Examiner*—Gary Pauman
(74) *Attorney, Agent, or Firm*—Webb Ziesenheim Logsdon Orkin & Hanson, P.C.

(57) ABSTRACT

A coaxial cable connector includes an RJ type female housing defining a cavity. A first conductor is received in the RJ type female housing with one end of the first conductor received in the cavity. The first conductor adjacent the one end contacts a second conductor received in a cavity of an RJ type plug body when the RJ type plug body adjacent the cavity thereof is received in the cavity of the RJ type female housing.

28 Claims, 22 Drawing Sheets

FIG. 1
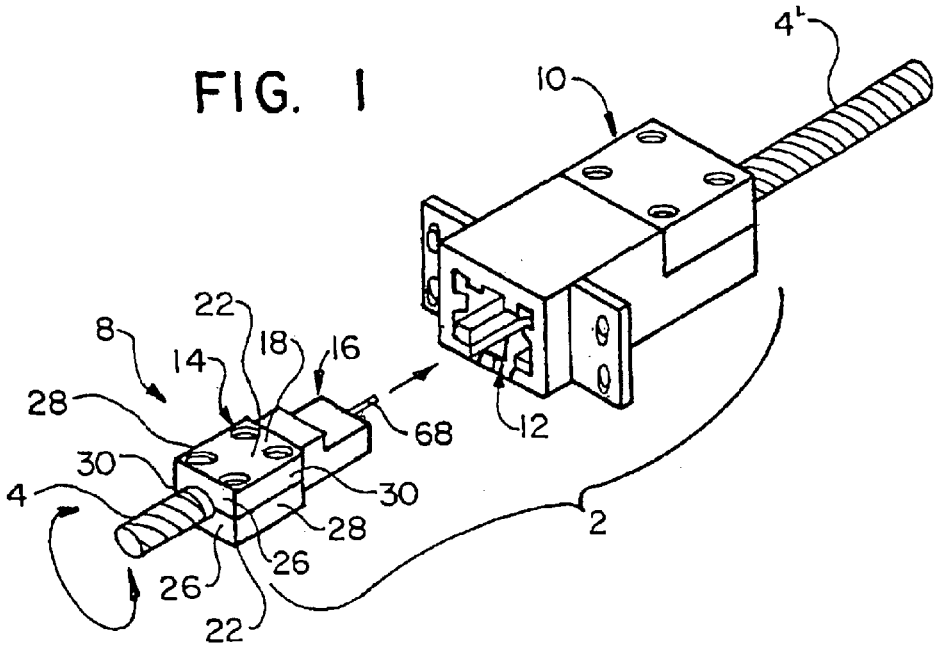
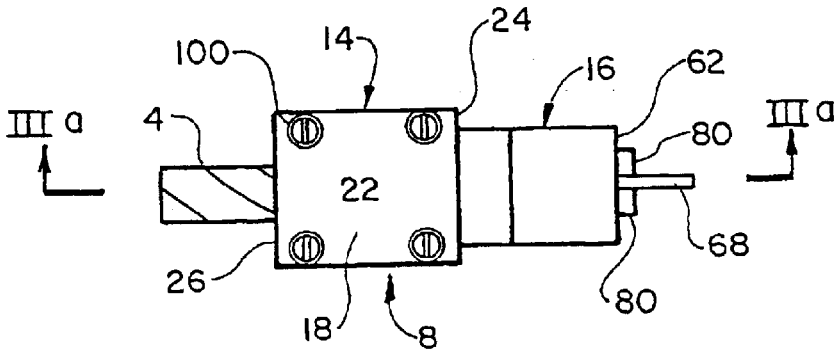
FIG. 2

8
14
16
18
22
24
26
34
36
38
40
42
44
46
48
56
58
60
62
64
68
70
72
74
76
78
80
82
84
86
90
92
94
96
100
4

RJ TYPE COAXIAL CABLE CONNECTOR

BACKGROUND OF THE INVENTION

1. Field of the Invention

The present invention relates to electrical connectors and, more specifically, to RJ type connectors for connection of broadband coaxial cables.

2. Background Art

Broadband coaxial cables and coaxial cable connectors are commonly used for connecting an RF signal source to an RF signal receiver. Some common RF signal sources/receivers include television and audio receivers, amplifiers, decoders, satellite receivers, VCRs, DVD players, cable modems and other data devices for broadband, and voice transceivers.

Prior art coaxial connectors include a female-type screw-on type connector or a female-type plug-on type connector which can be connected to a male-type connector. More specifically, the screw-on type connector includes a female receptacle having an internally threaded bore configured to threadedly mate with external threads of a male coaxial connector connected to, for example, an electronic product or the terminal end of a coaxial cable. A problem with the screw-on type coaxial connector is that the relative inflexible coaxial cable makes the screw-on type connector difficult to align and threadedly mate. The plug-on type coaxial connector includes a female receptacle having an inside diameter configured to frictionally interact with the external threads of a male coaxial connector. While the plug-on type coaxial connector is much easier to attach than the screw-on type coaxial connector, the plug-on type coaxial connector can be separated from the male coaxial connector simply by pulling the coaxial cable or the female receptacle from the male coaxial connector.

It is, therefore, an object of the present invention to overcome the above problems and others by providing a coaxial cable connector which can be utilized to easily connect and disconnect a pair of coaxial cables or connect a coaxial cable and a printed circuit board (PCB) while providing electromagnetic shielding of a signal conveyed on the core of the coaxial cable(s). Still other objects of the present invention will become apparent to those of ordinary skill in the art upon reading and understanding the following detailed description.

SUMMARY OF THE INVENTION

Accordingly, I have invented a coaxial cable connector comprising an RJ type male plug having a first cavity and a second cavity. A first conductor is received in the RJ type male plug with the first conductor having adjacent the first end thereof a first section received within the first cavity of the RJ type male plug. The first conductor also has adjacent a second end thereof a second section received within the second cavity of the RJ type male plug. The part of the RJ type male plug surrounding at least part of the first cavity has the form of a first fastener type. The first section of the first conductor is configured to electrically contact a central conductor of a first coaxial cable when the first coaxial cable is mated with the RJ type male plug via the first fastener type.

Preferably, the first section of the first conductor is in the form of a pin having a proximal end secured to the RJ type male plug and a distal end received in the first cavity of the RJ type male plug. The second section of the first conductor is preferably in the form of a clip having a proximal end connected to the proximal end of the pin and secured to the RJ type male plug, and a distal end received in the second cavity of the RJ type male plug and configured to expand and receive the central conductor of the first coaxial cable when the first coaxial cable is mated with the RJ type male plug via the first fastener type.

A first shield covers at least part of the first cavity of the RJ type male plug. The first shield is electrically isolated from the first conductor. The first shield is configured to electrically contact a shield of the first coaxial cable when the first coaxial cable is mated with the RJ type male plug via the first fastener type.

The coaxial cable connector can also or alternatively include an RJ type female housing having a first cavity and a second cavity. A second conductor is received in the RJ type female housing, with the second conductor having adjacent a first end thereof a first section received within the first cavity of the RJ type female housing. The second conductor also has adjacent a second end thereof a second section received within the second cavity of the RJ type female housing. The part of the RJ type female housing surrounding at least part of the first cavity has the form of a second fastener type. The first section of the second conductor is configured to be electrically connected with a central conductor of a second coaxial cable when the second coaxial cable is mated with the RJ type female housing via the second fastener type. The RJ type male plug adjacent the second cavity thereof is configured to be received in the second cavity of the RJ type female housing with the second end of the first conductor electrically contacting the second end of the second conductor.

Preferably, the first section of the second conductor is in the form of an elongated pin having a proximal end secured to the RJ type female housing and a distal end received in the first cavity of the RJ type female housing. The second section of the second conductor is preferably in the form of a clip having a proximal end connected to the proximal end of the elongated pin and secured to the RJ type female housing, and a distal end received in the second cavity of the RJ type female housing.

A second shield covers at least part of the first cavity of the RJ type female housing. The second shield is electrically isolated from the second conductor. The second shield is configured to be electrically connected with a shield of the second coaxial cable when the second coaxial cable is mated with the RJ type female housing via the second fastener type. The first shield of the first coaxial cable and the second shield of the second coaxial cable are electrically connected when the RJ type male plug adjacent the second cavity thereof is received in the second cavity of the RJ type female housing.

Preferably, the first fastener type has one of external male threads and internal female threads and the second fastener type has the other of internal female threads and external male threads. The second fastener type is preferably rotatable relative to the remainder of the RJ type female housing.

I have also invented a coaxial cable connector including an RJ type plug body having a first cavity configured to receive a first coaxial cable therein and a second cavity. A first conductor has a first end secured in the RJ type plug body and a second end received within the second cavity of the RJ type plug body. The first conductor has a bore which extends from the first end toward the second end of the first conductor. The bore is in communication with the first cavity and is configured to receive a central conductor of the first coaxial cable when the first coaxial cable is received in the first cavity.

A first shield covers at least part of the first cavity of the RJ type plug body. The first shield is electrically isolated from the first conductor. The first shield is configured to electrically contact a shield of the first coaxial cable when the first coaxial cable is received in the first cavity.

An RJ type housing body can also or alternatively be provided including a second conductor secured in the RJ type housing body with one end of the second conductor received in a cavity of the RJ type housing body. The cavity of the RJ type housing body is configured to receive therein the end of the RJ type plug body adjacent the second cavity thereof. The second conductor adjacent the one end thereof is configured to electrically contact the first conductor adjacent the second end thereof when the RJ type plug body adjacent the second cavity is received in the cavity of the RJ type housing body.

A second shield can cover at least part of the cavity of the RJ type housing body. The second shield is electrically isolated from the second conductor. Electrical continuity is established between the first shield of the first coaxial cable and the second shield of the second coaxial cable when the RJ type plug body adjacent the second cavity is received in the cavity of the RJ type housing body.

Preferably, the second conductor adjacent the one end thereof is in the form of a clip configured to mate with and grip the second section of the first conductor when the end of the RJ type plug body adjacent the second cavity is received in the cavity of the RJ type housing body.

The second conductor can include another end which projects out of the RJ type housing body for electrical connection with an electrically conductive trace disposed on a printed circuit board (PCB). The second conductor can also include another end which is electrically connected to a first PCB received in the RJ type housing body. In this embodiment, the RJ type housing body includes a conductive pin electrically connected to the second conductor via a conductive trace disposed on the first PCB. The conductive pin projects out of the housing body for electrical connection with a conductive trace disposed on a second PCB.

I have also invented a coaxial cable connector comprising an RJ type housing body having a cavity therein and a conductor secured in the RJ type housing body with one end of the conductor received in the cavity. Adjacent the one end thereof, the conductor has the form of a clip which receives and grips an end of a pin received in a cavity of an RJ type plug body when the RJ type plug body adjacent the cavity thereof is received in the cavity of the RJ type housing body.

The other end of the conductor can be in the form of a clip configured to receive a central conductor of a coaxial cable. The RJ type housing body includes a cover configured to coact with the RJ type housing body for receiving the other end of the conductor and the coaxial cable therebetween when the cover is secured to the housing body.

A shield can be provided having a first part at least partially covering the cavity of the RJ type housing body and a second part received between the housing body and the removable cover when the cover is secured to the housing body. The shield is electrically isolated from the conductor and electrically contacts a shield of the coaxial cable when the cover is secured to the housing body with the coaxial cable therebetween.

I have also invented a coaxial cable connector having an RJ type plug body including a cavity and a cylinder connected to the RJ type plug body. The cylinder has a bore therethrough in communication with the cavity of the RJ type plug body. A conductor is received in the bore of the cylinder. One end of the conductor is in the form of a pin received in the cavity of the RJ type plug body and the other end of the conductor is in the form of a clip configured to mate with a central conductor of a coaxial cable. A plurality of housing parts is configured to mate together with the elongated cylinder and the coaxial cable therebetween when the central conductor of the coaxial cable is mated with a clip of the conductor.

A shield can be provided for covering at least part of the RJ type plug body. A means can be provided for electrically connecting the shield covering the at least part of the RJ type plug body to a shield of the coaxial cable. The means for electrically connecting can be received between the mated housing parts and can include one or more contacts received in the mated housing parts with each contact extending between the shield covering the at least part of the RJ type plug and the shield of the coaxial cable.

Preferably, the RJ type plug body, the cylinder and the shield around the at least part of the RJ type plug body are rotatable relative to the coaxial cable and the mated housing parts around an axis of the bore of the cylinder.

I have also invented a coaxial cable connector having an RJ type housing configured to mate with a first coaxial cable having a central conductor in spaced coaxial relation with a conductive sheath. The RJ type housing has a conductor received therein and a shield in spaced relation covering at least part of the conductor of the RJ type housing. The conductor and the shield of the RJ type housing electrically contact the central conductor and conductive sheath, respectively, of the first coaxial cable when the RJ type housing and the first coaxial cable are mated.

The coaxial cable connector also includes an RJ type plug configured to mate with a second coaxial cable having a central conductor in spaced coaxial relation with a conductive sheath. The RJ type plug has a conductor received therein and a shield in spaced relation covering at least part of the conductor of the RJ type plug. The conductor and the shield of the RJ type plug electrically contact the central conductor and conductive sheath of the second coaxial cable, respectively, when the RJ type plug and the second coaxial cable are mated. The RJ type housing has a cavity configured to receive a part of the RJ type plug therein and the conductor and shield of the RJ type housing electrically contact the conductor and shield of the RJ type plug when the part of the RJ type plug is received in the cavity of the RJ type housing.

Lastly, I have invented an RJ type female connector comprising a housing configured to mate with a first coaxial cable having a conductive shield in spaced coaxial relation with a conductive core. The RJ type female connector has a plug receiving opening configured to receive and mate with an RJ type male connector which is configured to mate with a second coaxial cable having a conductive shield in spaced coaxial relation with a conductive core. The RJ type female connector and the RJ type male connector each have a conductor received therein and a conductive shield shielding at least part of the conductor. The conductor and conductive shield of each of the RJ type female connector and the RJ type male connector are electrically connected with the conductive core and conductive shield of the first coaxial cable and the second coaxial cable when the RJ type female connector and the RJ type male connector are mated with a first coaxial cable and a second coaxial cable, respectively. Conductivity is established between the conductive cores and the conductive shields of the first and second coaxial cables when the RJ type male connector is received in the plug receiving opening of the RJ type female connector.

BRIEF DESCRIPTION OF THE DRAWINGS

FIG. 1 is a perspective view of a wall mount RJ type coaxial cable connector having a male plug and a female housing in the form of a common RJ type connector to provide a snap fit connection for coaxial cables in accordance with one embodiment of the present invention;

FIG. 2 is a top view of the male plug of the coaxial cable connector shown in FIG. 1;

DETAILED DESCRIPTION OF THE PREFERRED EMBODIMENTS

Figures 3A, 3B:
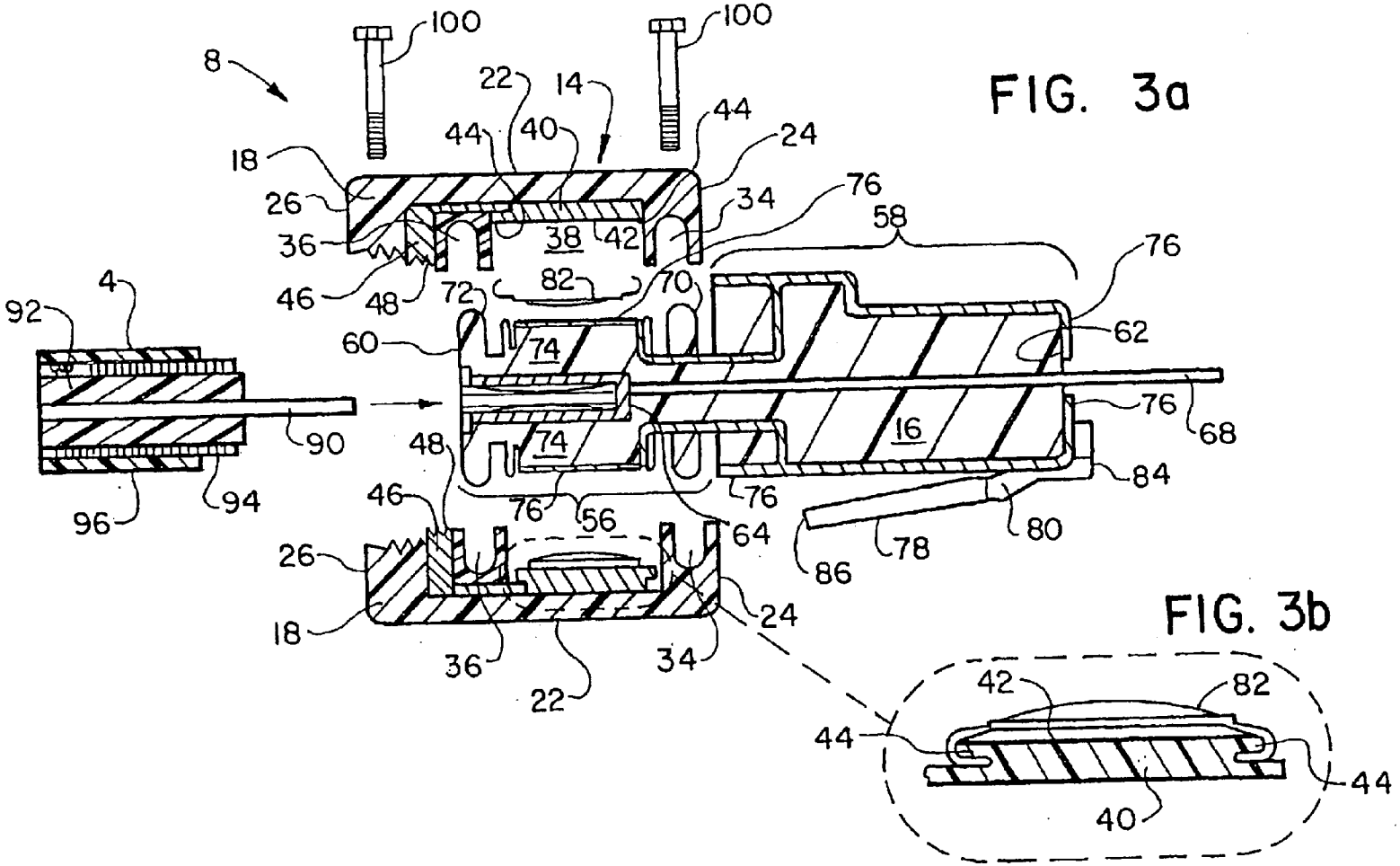
FIG. 3*a* is an exploded sectional view taken along lines IIIa—IIIa in FIG. 2.
FIG. 3*b* is an enlarged view of the leaf spring contact attached to an enclosure section in FIG. 3*a;*

The present invention will be described with reference to the accompanying Figures wherein like reference numbers correspond to like elements. The following detailed description includes words such as "horizontal", "vertical", "top" and "bottom". It is to be understood that these words are used in connection with the various views and embodiments of the present invention shown in the Figures and are not to be construed as limiting the invention.

With reference to FIG. 1, an RJ type coaxial cable connector 2 can be utilized to easily, removably connect a coaxial cable 4 and a coaxial cable 4'. The coaxial cable connector 2 includes a male plug 8 and a female housing 10 having a receiving aperture 12 configured to receive plug 8 therein.

Plug 8 includes an enclosure 14 which is received around one end of an elongated and insulating plug body 16. The enclosure 14 preferably includes a pair of insulating enclosure sections 18 that can be mated together to form enclosure 14.

With reference to FIGS. 2–3*b,* and with continuing reference to FIG. 1, each enclosure section 18 includes a top 22, a first end 24, a second end 26, a first side 28 and a second side 30. Adjacent first end 24, each enclosure section 18 includes a first alignment slot or hole 34. Between first alignment slot 34 and second end 26, each enclosure section 18 includes a second alignment slot or hole 36. Between first alignment slot 34 and second alignment slot 36, each enclosure section 18 includes a trough 38 having a conductive coating or sheet 40 received in a base thereof. Each enclosure section 18 includes a conductive contact 46 between second alignment slot 36 and second end 26, preferably adjacent second alignment slot 36. Each contact 46 includes an outer edge 48 which faces opposite top 22 and an edge opposite outer edge 48 which is electrically connected to sheet 40. Each sheet 40 includes an outer surface 42 which faces opposite top 22 and a pair flared and rolled sides 44 which extend from sheet 40 toward first alignment slot 34 and second alignment slot 36.

Plug body 16 includes abase 56 and a neck 58 adjacent a respective first end 60 and second end 62 thereof. A conductive cylinder 64 is received in base 56. Conductive cylinder 64 extends from first end 60 toward second end 62 and preferably terminates before neck 58. A conductive wire 68 is connected in electrical contact with cylinder 64. Conductive wire 68 extends from cylinder 64 through neck 58 to second end 62. In the embodiment shown in FIG. 3*a,* wire 68 has an exposed end which extends outward from second end 62.

Base 56 includes a first alignment rib or pin 70 and a second alignment rib or pin 72 configured to mate with first alignment slot 34 and second alignment slot 36, respectively, of each enclosure section 18. Base 56 also includes a ring 74 positioned between and spaced from first alignment rib 70 and second alignment rib 72. Preferably, first and second alignment slots 34 and 36 of each enclosure section 18 have an arcuate form between first side 28 and second side 30. Moreover, the outer surfaces of first and second alignment ribs 70, 72 and ring 74 are preferably circular and coaxial with a longitudinal axis of cylinder 64. Preferably, when enclosure 14 is formed around base 56, the first and second alignment slots 34 and 36 of each enclosure section 18 coact to form circular alignment slots that receive first and second alignment ribs 70 and 72, respectively, so that enclosure 14 and plug body 16 are rotatable with respect to each other around the longitudinal axis of cylinder 64.

A coating or sheet 76 is disposed on plug body 16 so it surrounds, but is electrically isolated from, cylinder 64 and wire 68. In the embodiment shown in FIG. 3*a*, conductive sheet 76 is disposed on a periphery of base 56 and a periphery of neck 58, preferably ring 74, around cylinder 64 and wire 68, respectively. Between cylinder 64 and neck 58, sheet 76 is preferably disposed through plug body 16. Preferably, first and second alignment ribs 70 and 72 do not include sheet 76 thereon to promote rotation between enclosure 14 and plug body 16.

Connector 2 includes a lever 78 having a first end 84 connected to plug body 16 adjacent second end 62 thereof Lever 78 extends from second end 62 toward first end 60 and away from plug body 16 and terminates in a second end 86 spaced from plug body 16. A pair of wings 80 extend from opposite sides of lever 78 adjacent second end 62 of plug body 16. Preferably, lever 78 has a spring memory which enables second end 86 to return to a position in spaced relation with plug body 16 after being urged toward plug body 16.

To promote electrical contact between sheet 40 of each enclosure section 18 and sheet 76 disposed on plug body 16, a conductive leaf spring contact 82 is biased between sheet 40 of each enclosure section 18 and sheet 76 disposed on plug body 16, preferably the portion of sheet 76 surrounding ring 74, when the plurality of enclosure sections 18 are mated to form enclosure 14. To avoid movement between each leaf spring contact 82 and sheet 40, opposite sides of each leaf spring contact 82 are fitted around the flared and rolled sides 44 of sheet 40 as shown in FIG. 3*b*. When the plurality of enclosure sections 18 are mated to form enclosure 14, sheets 40, sheet 76 and leaf spring contacts 82 coact to form a shield around cylinder 64 and wire 68 for electromagnetically shielding cylinder 64 and wire 68.

Coaxial cable 4 includes a conductive core 90 surrounded by an insulating jacket 92. Insulating jacket 92 is surrounded by a conductive shield 94 which is surrounded by an insulating sheath 96. A portion of shield 94 is exposed between the end of jacket 92 and the end of sheath 96, and core 90 has an exposed end that extends outward from an end of jacket 92.

Prior to forming enclosure 14 around base 56, coaxial cable 4 is mated with plug 16. Specifically, the exposed end of core 90 is received in cylinder 64 so that the end of jacket 92 abuts or is closely adjacent first end 60 of plug body 16. Next, the enclosure sections 18 are mated together around base 56, jacket 92, shield 94 and sheath 96 adjacent the end of coaxial cable 4. When enclosure sections 18 are mated together to form enclosure 14, edge 48 of contact 46 of each enclosure section 18 and an edge of each enclosure section 18 adjacent second end 26, facing in a direction opposite top 22, contacts and clamps the respective shield 94 and insulating sheath 96 of first coaxial cable 4 therebetween. Clamping coaxial cable 4 between enclosure sections 18 in this manner avoids withdrawal of the exposed end of core 90 from cylinder 64.

Figure 4:
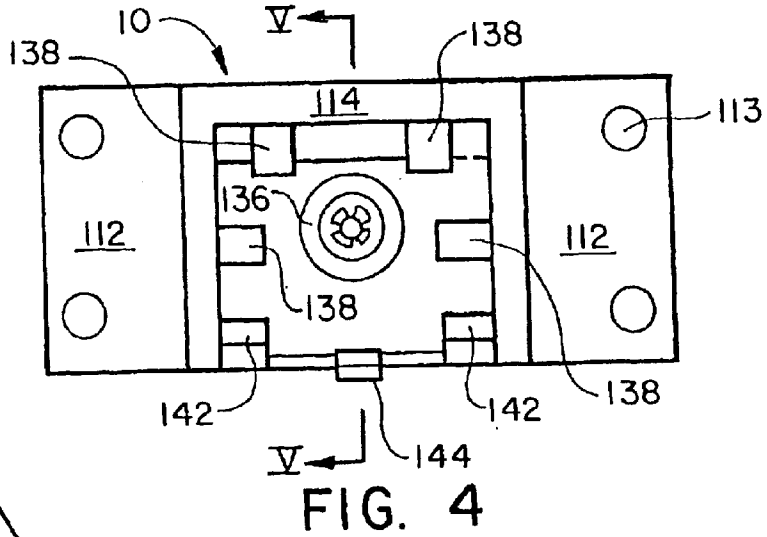
FIG. 4 is a view of the receiving aperture end of the female housing in FIG. 1.
Figure 5:
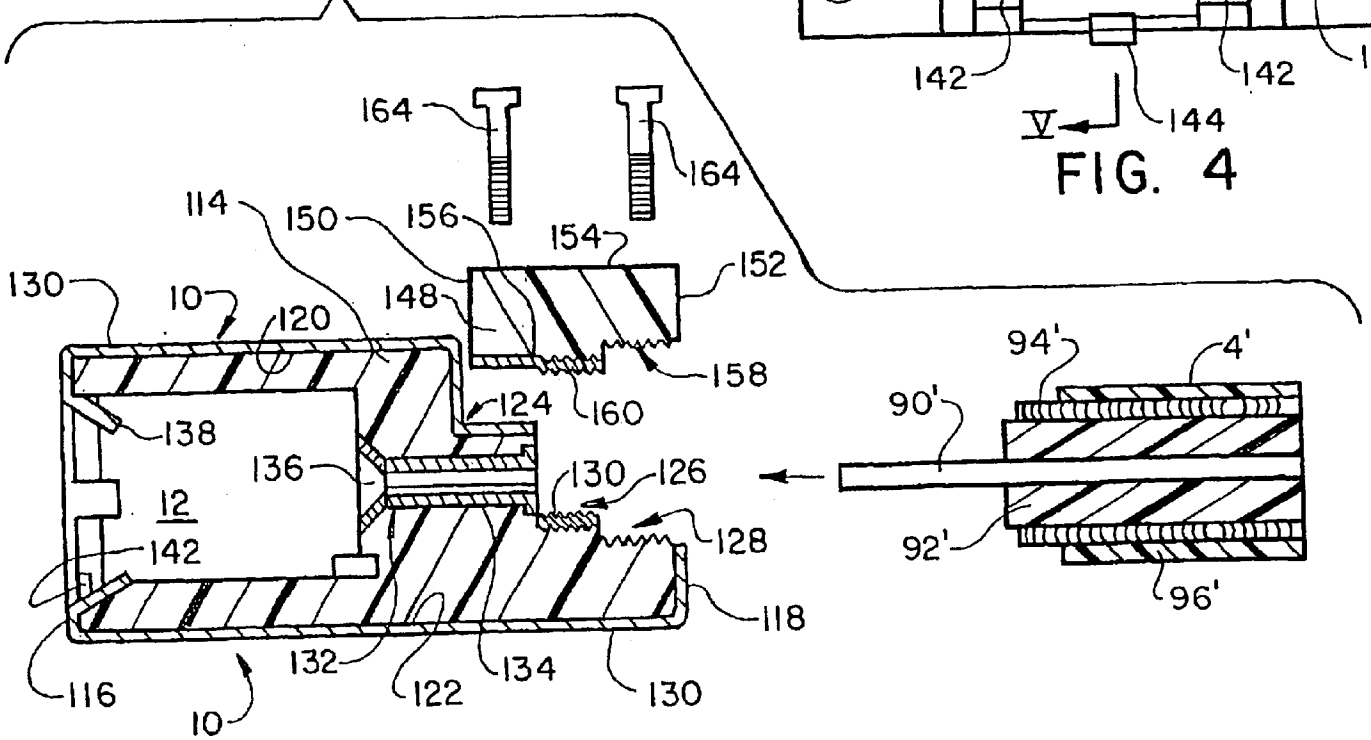
FIG. 5 is an exploded sectional view taken along lines V—V in FIG. 4.

With reference to FIGS. 4 and 5, and with continuing reference to FIGS. 1–3*b,* in one embodiment of the present invention, housing 10 includes a pair of flanges 112 which extend from opposite sides of an insulating housing body 114. Each flange 112 includes one or more holes 113, with each hole 113 configured to receive a fastener for mounting housing 10 to a wall. Housing body 114 also includes a first end 116, a second end 118, a top 120 and a bottom 122. Housing body 114 includes a plurality of stair steps 124, 126 and 128 which converges from top 120 toward bottom 122 adjacent second end 118. Housing body 114 includes a conductive coating or sheet 130 surrounding receiving aperture 12 which has a mouth which opens toward first end 116 for receiving neck 58 of plug body 16.

A conductor 132 is received in housing body 114 between receiving aperture 12 and the vertical surface of stair step 126. In the embodiment shown in FIGS. 4 and 5, conductor 132 includes a cylinder 134 having a truncated cone 136 which converges from receiving aperture 12 toward cylinder 134.

Sheet 130 surrounds housing body 114 and is electrically insulated thereby from cylinder 134 and cone 136. Preferably, sheet 130 includes tabs 138 which extend into receiving aperture 12 for electrically contacting sheet 76 when neck 58 is received in receiving aperture 12. A pair of lock wings 142 are positioned on opposite sides of the mouth of receiving aperture 12 adjacent bottom 122 to engage wings 80 of lever 78 in a manner known in the art, when neck 58 is received in receiving aperture 12. Second end 86 of lever 78 can be urged toward plug body 16, thereby lifting wings 80 above lock wings 142 and avoiding interference therebetween so that neck 58 can be removed from receiving aperture 12.

In the embodiment shown in FIG. 5, housing 10 includes a cap 148 having a first end 150, a second end 152, a top 154 and a bottom 156. Bottom 156 includes a stair step 158 which converges from bottom 156 toward top 154 adjacent second end 152. Preferably, bottom 156 of cap 148, other than on the horizontal and vertical surfaces of stair step 158, includes a conductive sheet or coating 160 thereon.

To secure coaxial cable 4' to housing 10, an exposed portion of core 90' is received in cylinder 134 with the end of jacket 92' abutting or closely adjacent the horizontal surface of stair step 126. When core 90' of coaxial cable 4' is received in cylinder 134 in this manner, the exposed portion of shield 94' between the end of jacket 92' and the end of sheath 96' electrically contacts the portion of sheet 130 on the horizontal surface of stair step 126, and sheath 96' contacts the horizontal surface of stair step 128.

Next, cap 148 is mated to housing body 114 with first end 150 abutting or closely adjacent to the horizontal surface of stair step 124 and with sheet 160 contacting and bridging shield 94' and the portion of sheet 130 on the horizontal surface of stair step 124. Next, cap 148 is secured to housing body 114 by screws 164 received in receiving apertures (not shown) of cap 148 and housing body 114 to secure coaxial cable 4' and housing 10 together. Securing cap 148 and housing body 114 together, clamps shield 94' between sheet 160 and sheet 130 on the horizontal surface of stair step 124 and clamps sheath 96' between the horizontal surface of stair step 158 and the horizontal surface of stair step 128. Clamping coaxial cable 4' between housing body 114 and cap 148 in this manner avoids withdrawal of the exposed end of core 90' from cylinder 134.

In use, when plug 8 and housing 10 are secured to coaxial cable 4 and coaxial cable 4', respectively, and when neck 58 is received in receiving aperture 12, an electrical connection is formed between cores 90, 90' and shields 94, 94' of coaxial cables 4 and 4' by the electrical contact formed by tabs 138 between sheets 76 and 130. Preferably, receiving aperture 12 is configured so that when neck 58 is received therein, the exposed end of wire 68 is guided by truncated cone 136 into cylinder 134.

Sheet 40 of each enclosure section 18 and sheet 76 surrounding plug body 16 coact to form an electromagnetic shield around cylinder 64 and the portion of wire 68 received in plug body 16. These sheets 40 and 76 coact with shield 94 of first coaxial cable 4 to electromagnetically shield signals propagating between core 90 of coaxial cable 4, cylinder 64 and the portion of wire 68 received in plug body 16. Similarly, sheet 130 and sheet 160 coact with shield 94' of coaxial cable 4' to electromagnetically shield signals propagating between core 90' and cylinder 134. When received in cylinder 134, the exposed end of wire 68 is electromagnetically shielded by sheet 130. As discussed above, when neck 58 is received in receiving aperture 12 and tabs 138 of sheet 130 contact sheet 76, a continuous electromagnetic shield is formed by plug 8 and housing 10 between shield 94 of coaxial cable 4 and shield 94' of coaxial cable 4'.

Figure 6:
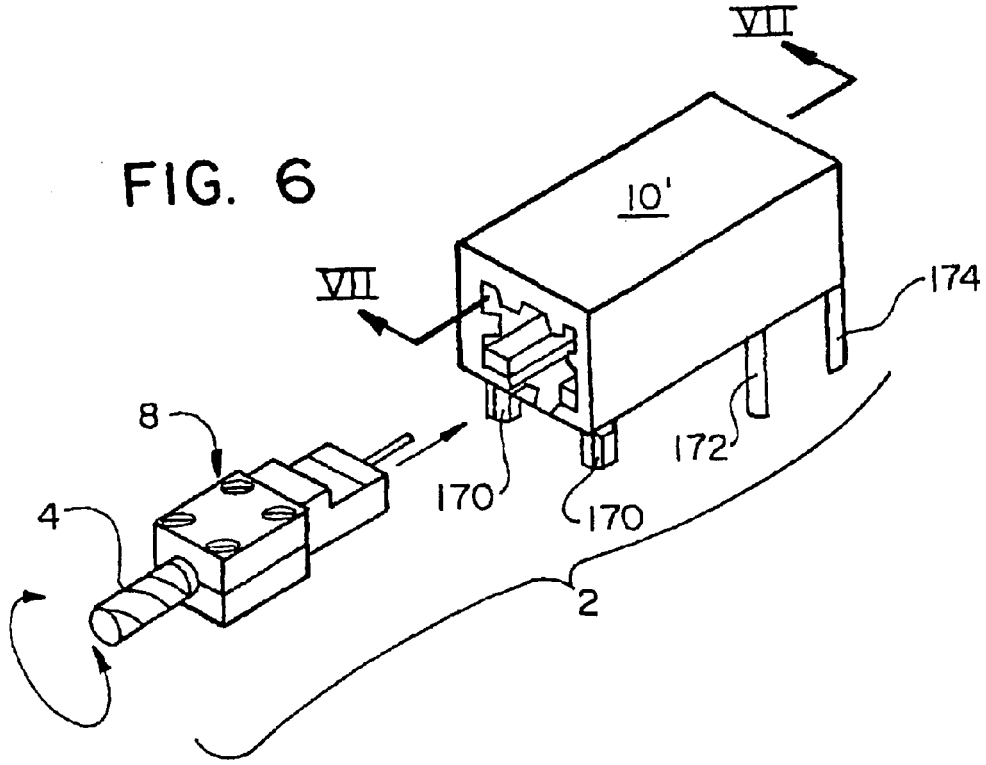
FIG. 6 is a perspective view of an RJ type PCB mount coaxial cable connector having a male plug and a female housing in the form of a common RJ type connector to provide a snap fit connection for a coaxial cable and a PCB in accordance with another embodiment of the present invention.
Figure 7:
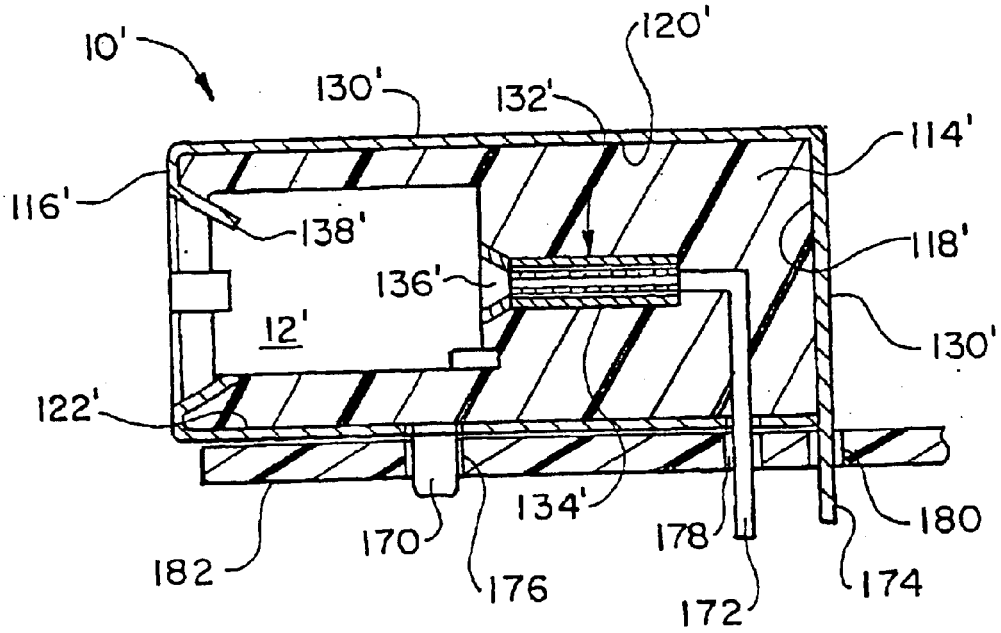
FIG. 7 is a sectional view taken along lines VII—VII in FIG. 6.

With reference to FIGS. 6 and 7, and with continuing reference to FIGS. 1–5, another embodiment of the RJ type coaxial cable connector 2 includes plug 8 described above and a housing 10'. Housing 10' has a one-piece housing body 114' having one or more mounting posts 170 extending from the bottom 122' thereof. A conductive pin 172 is electrically connected to conductor 132' and, more particularly, to cylinder 134' which comprises conductor 132'. Pin 172 extends through housing body 114' and outward from bottom 122'.

Sheet 130' surrounds housing body 114' and is electrically isolated thereby from cylinder 134' and pin 172. Sheet 130' has tabs 138' for contacting sheet 76 when neck 58 of plug body 16 is received in receiving aperture 12'. Sheet 130' also includes a conductive shield pin 174 which extends outward from bottom 122'. Mounting posts 170, pin 172 and shield pin 174 are configured to be received in through-holes 176, 178 and 180, respectively, of a conventional printed circuit board (PCB) 182. Preferably, through-holes 178 and 180 each have an internal plating that is electrically connected to a conductive trace (not shown) disposed on PCB 182 which is connected to one or more electronic components (not shown) mounted on PCB 182 in a manner known in the art. A solder (not shown) is preferably introduced between pin 172 received in plated through-hole 178 and between shield pin 174 received in plated through-hole 180 to promote electrical contact therebetween.

Figures 8, 9:
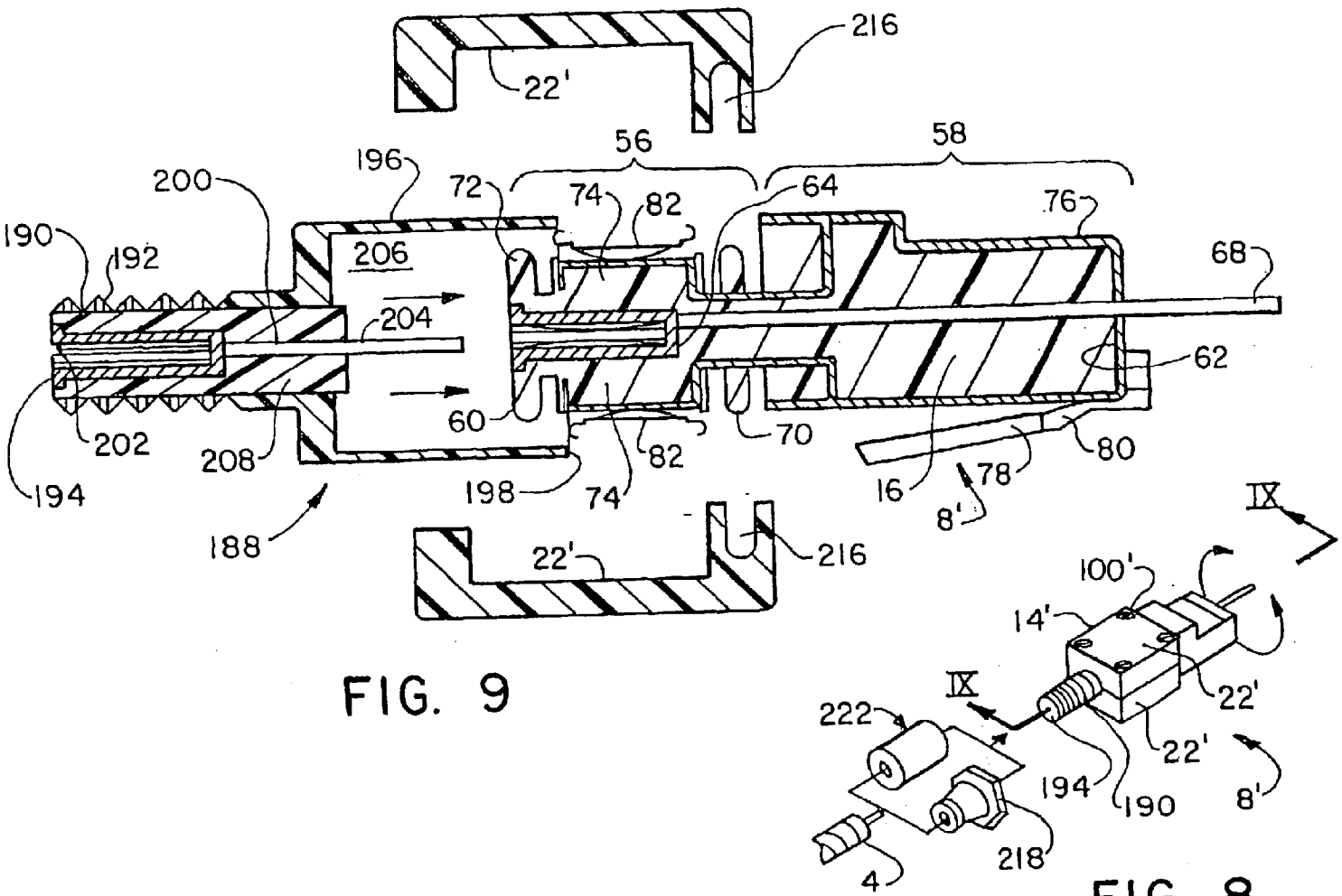
FIG. 8 is a perspective view of another embodiment of the male plug of the coaxial cable connector in accordance with the present invention.
FIG. 9 is an exploded sectional view taken along lines IX—IX in FIG. 8.

With reference to FIGS. 8 and 9, and with continuing reference to FIGS. 1–7, another embodiment of coaxial cable connector 2 includes housing 10 or 10' and plug 8' including plug body 16, cylinder 64, wire 68, first and second alignment ribs 70 and 72, ring 74, sheet 76, lever 78 and wings 80 described above and a sleeve assembly 188. Sleeve assembly 188 includes an externally threaded, male coaxial connector 190 at a first end 194 thereof and a conductive sleeve 196 having a mouth which opens toward a second end 198 thereof. Connector 190 has a conductive core 200 that includes a cylinder 202 adjacent first end 194 and a wire 204 which extends from cylinder 202 through connector 190 and which has an exposed end which extends into a cavity 206 defined by conductive sleeve 196. Connector 190 includes conductive external threads 192 which are electrically connected to sleeve 196. External threads 192 and sleeve 196 are electrically isolated from core 200 by an insulating jacket 208 therebetween.

Figure 10:
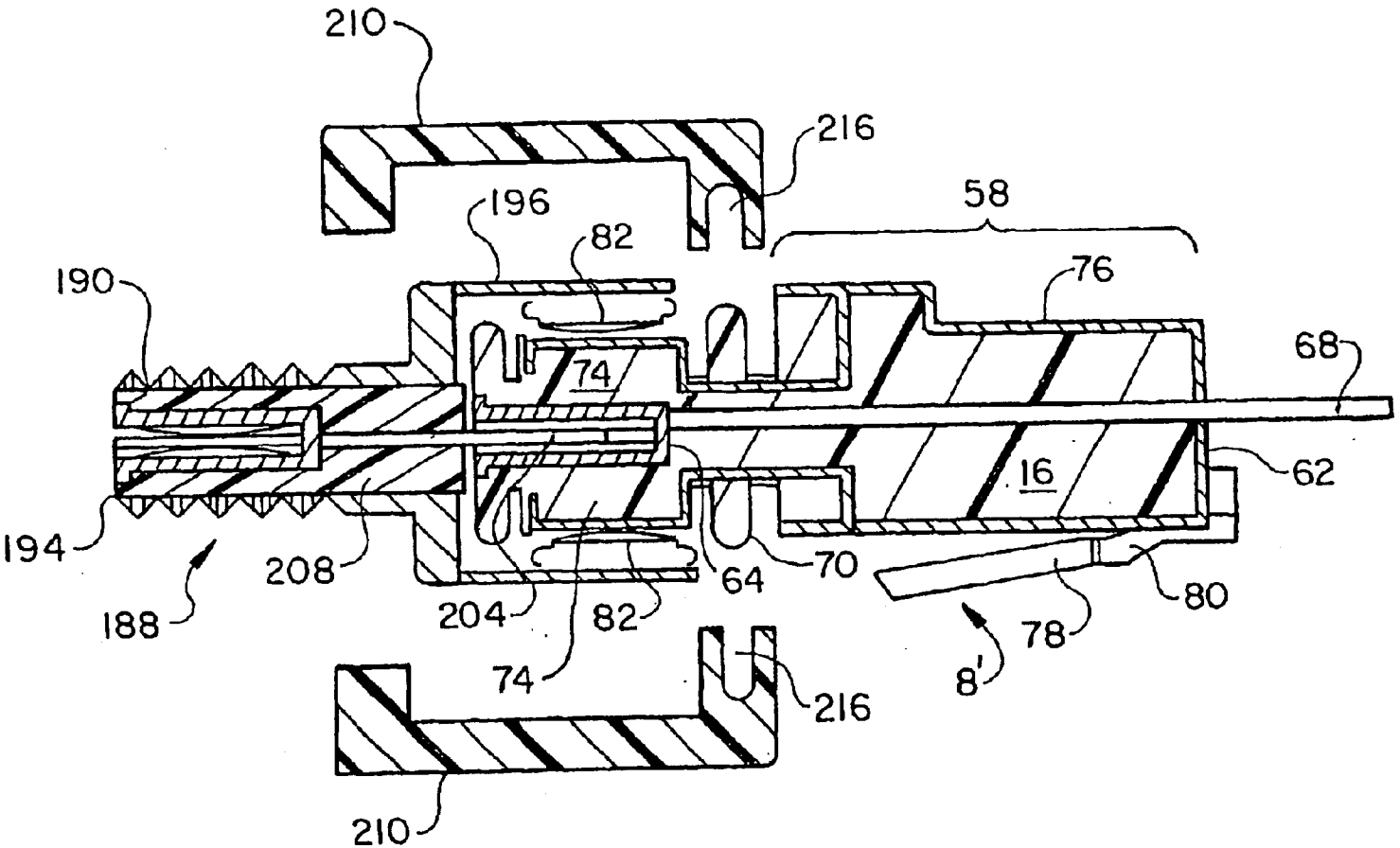
FIG. 10 is a partially assembled sectional view of the male plug in FIG. 9.

With reference to FIG. 10, and with ongoing reference to FIGS. 8 and 9, in use, base 56 is received in cavity 206 and the exposed end of wire 204 is received in cylinder 64 with first end 60 of plug body 16 abutting or closely adjacent an end of jacket 208 facing cavity 206. To promote contact between sleeve 196 and sheet 76, preferably with the portion of sheet 76 disposed on ring 74, one or more leaf spring contacts 82 are biased therebetween.

Next, a pair of enclosure sections 22' are mated around sleeve 196 and first alignment rib 70 of plug body 16 and are secured together by screws 100' to form an enclosure 14', shown best in FIG. 8. More specifically, each enclosure section 22' includes an arcuate alignment slot 216 configured to receive first alignment rib 70 when enclosure sections 210 are mated therearound. Preferably, when the pair of enclosure sections 210 are mated together, the alignment slots 216 thereof coact to form a circular alignment slot which receives first alignment rib 70 therein so that enclosure 14' and plug body 16 are rotatable with respect to each other around the longitudinal axis of cylinder 64.

Once plug 8 is assembled, external threads 192 of connector 190 can be mated with an internally threaded female coaxial connector 218 or a friction fit female coaxial connector 222 connected to the end of coaxial cable 4 in a manner known in the art.

In each of the foregoing embodiments of coaxial cable connector 2, the exposed end of wire 68 is received in cylinder 134 or 134', respectively. In the embodiment of coaxial cable connector 2 shown in FIG. 11, however, conductive wire 68 is replaced with one or more conductive wires or strips 228 that extend through plug body 16 and are exposed along the face of second end 62 and, preferably, a top surface 230 of plug body 16 adjacent second end 62 in the same manner as the conductors of a male plug of a conventional RJ type connector. Moreover, one or more conductive wires or strips 232 are disposed through receiving aperture 12 or 12' between a sidewall 236 thereof and a wire or strip form of conductor 132 or 132' in the same manner as the conductive strips of a female housing of a conventional RJ type connector. The exposed surfaces of each wire 228 and the portion of each strip 232 disposed through receiving aperture 12 or 12' are oriented to contact each other when neck 58 is received in receiving aperture 12 or 12'.

Figure 11:
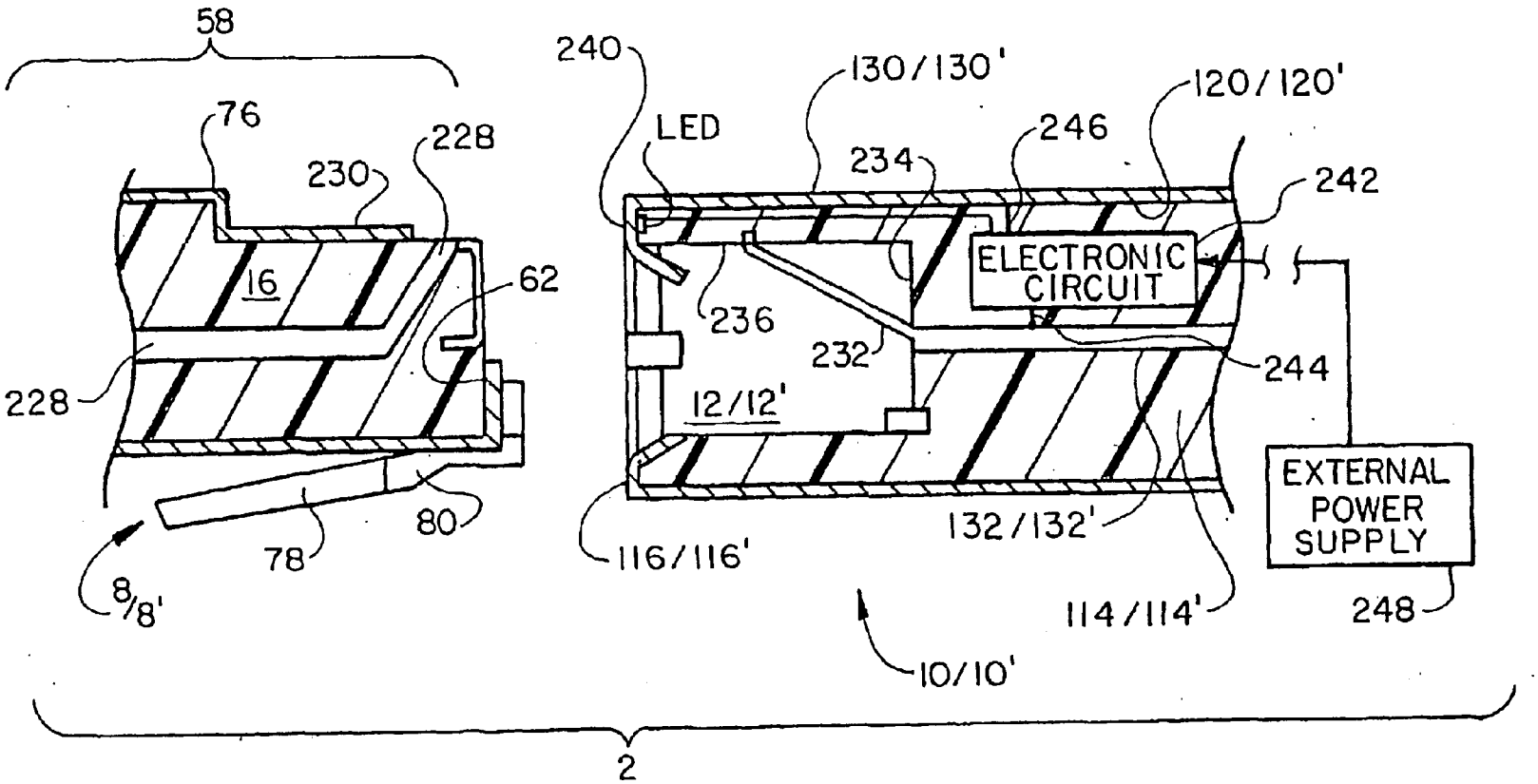
FIG. 11 is a partial sectional view of another embodiment of the mating ends of the coaxial cable connectors in accordance with the present invention.

In the embodiment of coaxial cable connector 2 shown in FIG. 11, the end of plug 8 or 8' opposite second end 62 can be of the form shown in FIGS. 3*a* and 3*b* or FIGS. 9 and 10, with the ends of the one or more conductive wires 228 opposite second end 62 connected to cylinder 64. Similarly, the end of housing 10 or 10' opposite the mouth of receiving aperture 12 or 12' can be of the form shown in FIGS. 4 and 5 or FIGS. 6 and 7 and the conductor 130 can include wire 172 and/or cylinder 134 or 134' as required by the application.

As shown in FIG. 11, housing 10 or 10' can include a lamp 240, preferably a light emitting diode (LED), disposed within the volume of housing body 114 or 114' for viewing adjacent and abutting the mouth of receiving aperture 12 or 12'. Lamp 240 is connected to an electronic circuit 242 also disposed within the volume of housing body 114 or 114'. Electronic circuit 242 is connected by conductors 244 and 246 to conductor 132 or 132' and sheet 130 or 130', respectively. Electronic circuit 242 is also connected to an external power supply 248 which can be mounted on PCB 182 or another suitable mounting fixture to which housing 10 or 10' is mounted. In response to detecting a voltage above a threshold level between conductor 132 or 132' and sheet 130 or 130', electronic circuit 242 causes lamp 240 to receive from external power supply 248 sufficient electrical power to cause lamp 240 to illuminate. In addition, where one or more lamps 240 are provided, electronic circuit 242 can be configured to detect for the presence of analog or digital signals at two or more frequencies, e.g., audio and video frequencies of a standard television signal, and to illuminate one of lamps 240 in response to detecting a signal at one frequency, another lamp 240 in response to detecting a signal at another frequency, and so forth.

Figure 12:
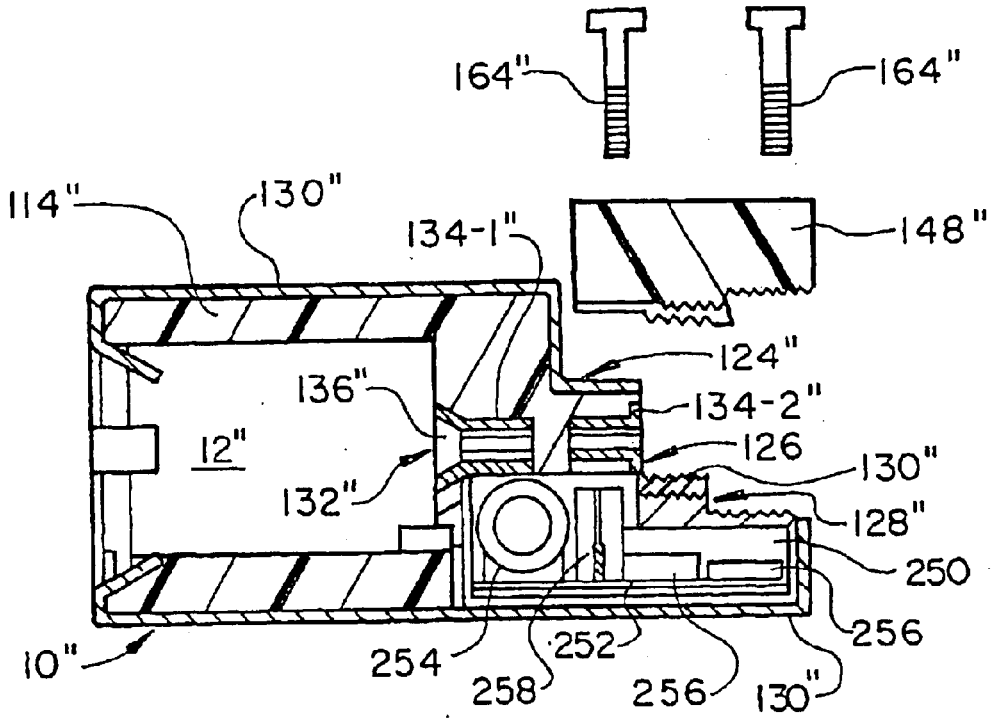
FIG. 12 is an exploded sectional view of a female housing in accordance with another embodiment of the invention including a filter circuit therein.

With reference to FIG. 12, and with reference back to FIGS. 1–5, another embodiment of the RJ type coaxial cable connector 2 includes plug 8 and a housing 10". Housing 10" has a similar configuration to housing 10 shown in FIG. 5, however, housing 10" includes conductor 132" which has a first cylinder 134-1" and a truncated cone 136" which converges from receiving aperture 12" toward cylinder 134-1". Conductor 132" also has a second cylinder 134-2" which extends from the vertical surface of stair step 126" toward first cylinder 134-1" and which terminates in opposition therewith. Preferably, first cylinder 134-1" and second cylinder 134-2" are positioned coaxially and have a portion of insulating housing body 114" disposed therebetween for insulating first cylinder 134-1" and second cylinder 134-2" from each other. Housing 10" includes a filter circuit 250 disposed in housing body 114'. Filter circuit 250 is preferably configured to filter unwanted frequencies propagating between first cylinder 134-1" and second cylinder 134-2". Preferably, filter circuit 250 includes a printed circuit board (PCB) 252 having one or more inductors 254, one or more capacitors 256 and/or one or more resistors 258 mounted thereon in a manner known in the art. Inductors 254, capacitors 256 and/or resistors 258 are electrically connected in a manner known in the art between first cylinder 134-1", second cylinder 134-2" and sheet 130" to filter desired frequencies from propagating between first cylinder 134-1" and second cylinder 134-2".

Figure 13:
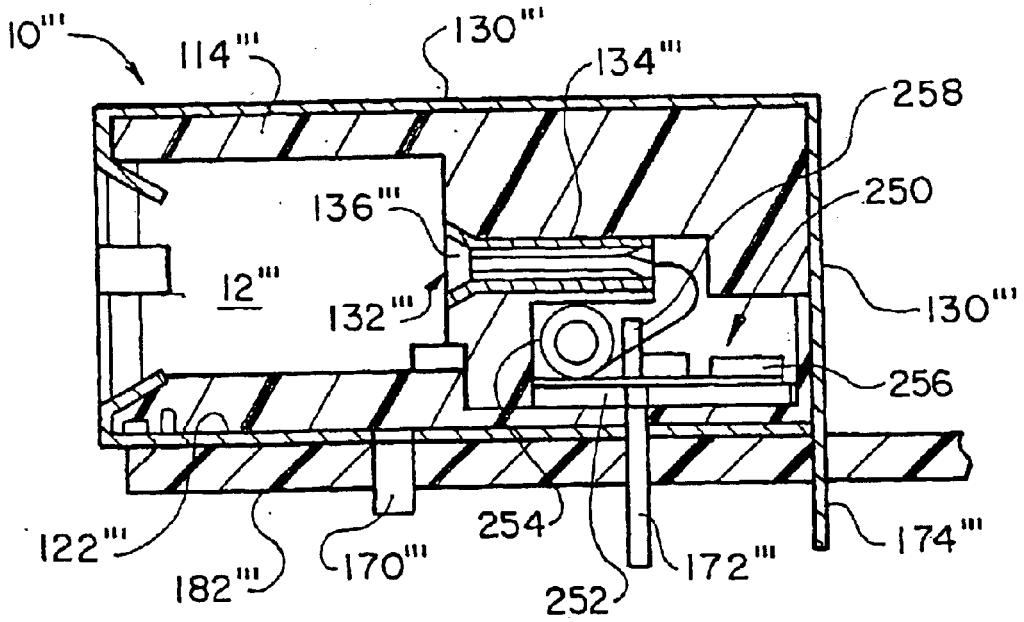
FIG. 13 is an exploded sectional view of a female housing in accordance with another embodiment of the invention including a filter circuit therein.

With reference to FIG. 13, and with reference back to FIGS. 1–3*b*, 6 and 7, another embodiment of the RJ type coaxial connector 2 includes plug 8 described above and a housing 10'". Housing 10'" has a one piece housing body 114'" having one or more posts 170'" extending from a bottom 122'" thereof. Housing 10'" has a conductor 132'", preferably a cylinder 134'" and a truncated cone 136'" which converges from receiving aperture 12'" toward cylinder 134'". A conductive pin 172'" extends from an interior of housing body 114'" outward from bottom 122'". Housing body 114'" includes filter circuit 250 received therein in the same manner as filter circuit 250 in FIG. 12. Filter circuit 250 in FIG. 13 is electrically connected between cylinder 134'", pin 172'" and sheet 130'" in the same manner as filter circuit 250 is connected between first cylinder 134-1", second cylinder 134-2" and sheet 130" in FIG. 12. In this respect, the one or more inductors 254, one or more capacitors 256 and/or one or more resistors 258 are connected in a manner known in the art to filter desired frequencies propagating between cylinder 134'" and pin 172'".

Housing 10" and 10'" are configured to receive the exposed end of wire 68 in first cylinder 134-1" and cylinder 134'", respectively. However, conductive wire 68 can be replaced with one or more conductive wires 228 disposed on the surface of plug 8 as shown in FIG. 11. Moreover, conductive wires or strips can be received in receiving aperture 12" or 12'" and connected to a conductive wire or strip form of conductor 132" or 132'" in the same manner as strips 232 in FIG. 11. Moreover, while FIGS. 12 and 13 show one filter circuit 250, each electrically isolated conductor 132" and 132'" disposed in housing 10" and 10'", respectively, can have a dedicated filter circuit 250 connected thereto.

Figure 14A:
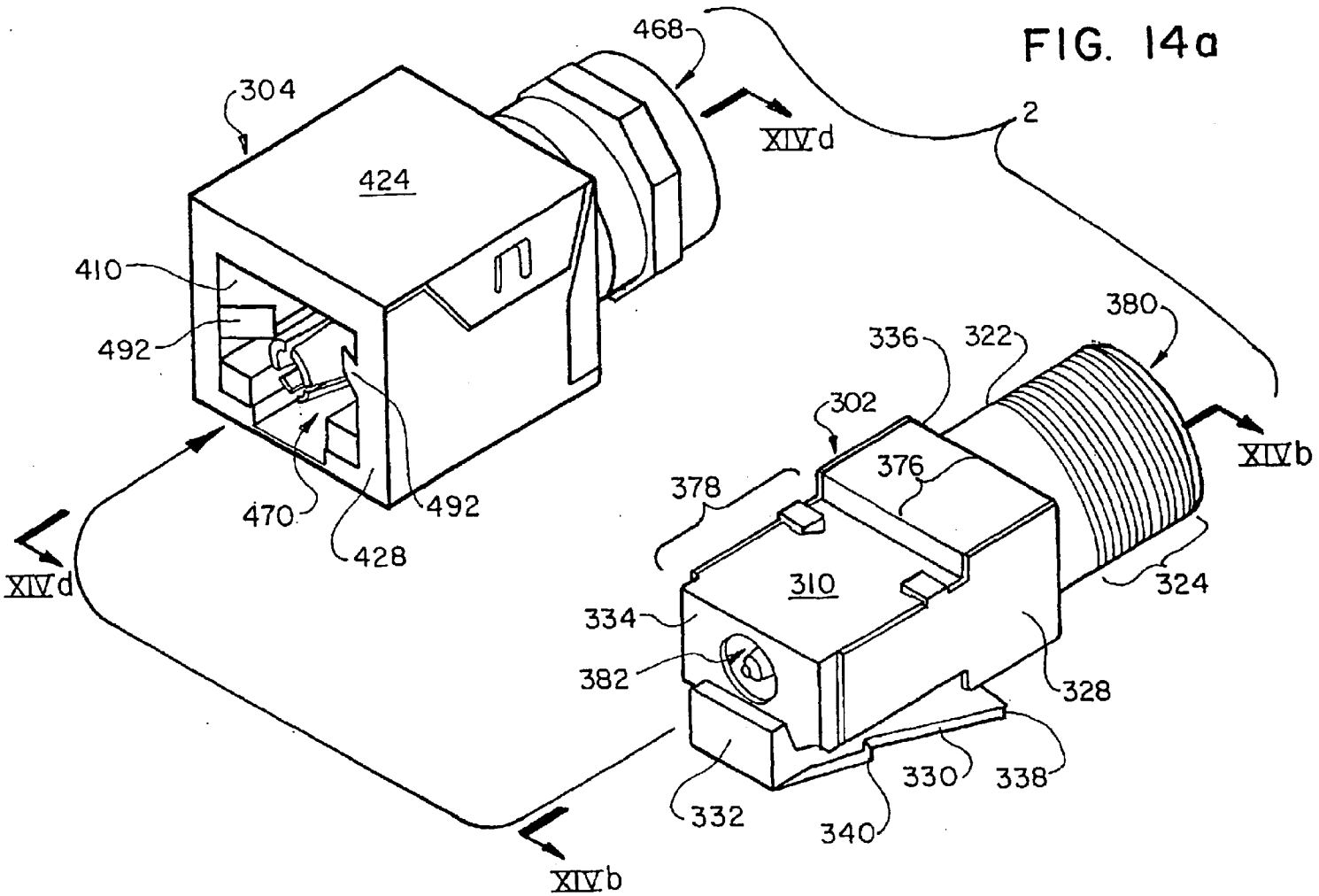
FIG. 14*a* is a perspective view of a coaxial cable connector including a male plug and a female housing in accordance with another embodiment of the present invention.
Figure 14B:
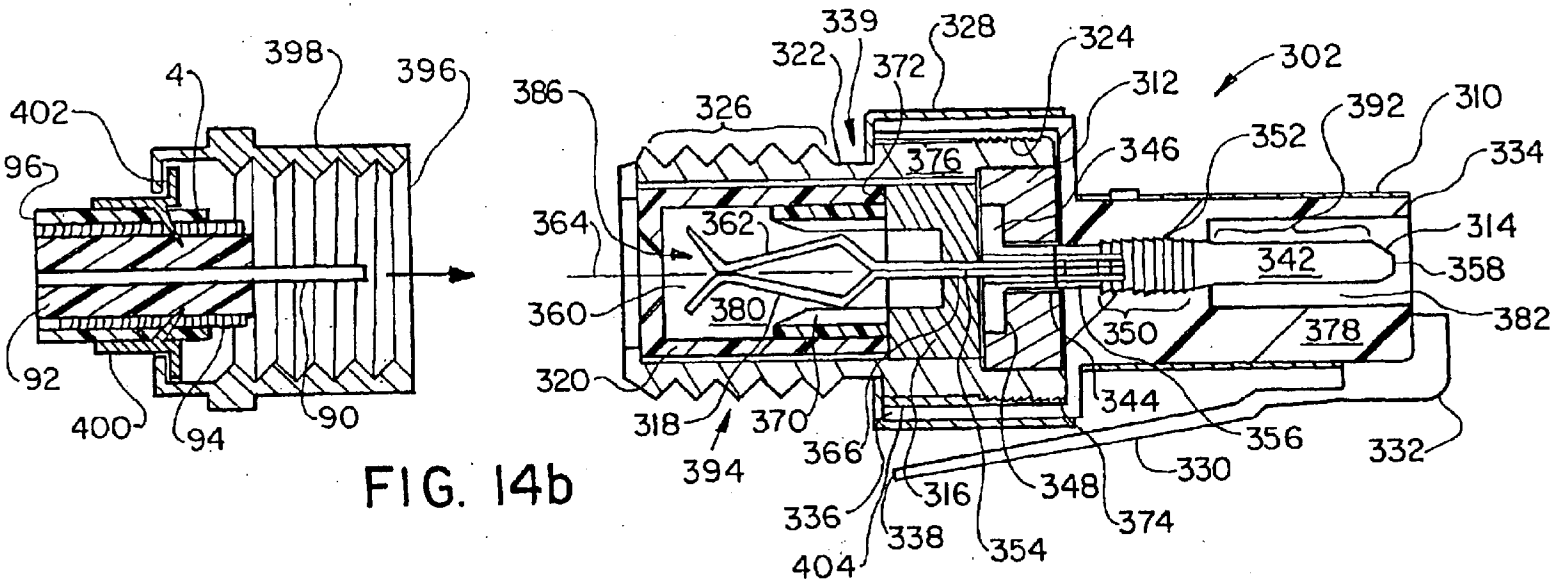
FIG. 14*b* is a cross section of the male plug in FIG. 14*a* and a cross section of a coaxial cable and a screw-on type connector.
Figure 14C:
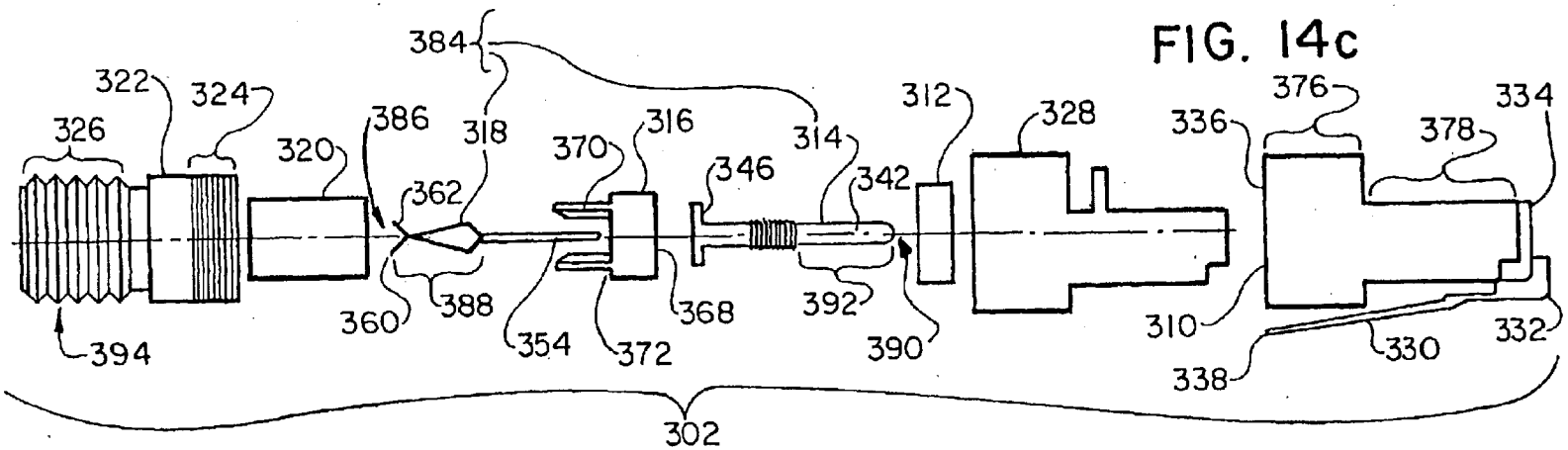
FIG. 14*c* is an exploded side view of the male plug in FIG. 14*a;*

With reference to FIGS. 14*a*–14*c*, another embodiment of RJ type coaxial cable connector 2 includes a male plug 302 and a female housing 304. Male plug 302 includes an insulating plug body 310, an insulating ferrule 312, an elongated conductive pin 314, an insulating collar 316, a conductive clip 318, a conductive sleeve 320 and a conductive tube 322 having first external male threads 324 adjacent one end thereof and second external male threads 326 adjacent the other end thereof Preferably, second external male threads 326 have the form of a first fastener type 394 which is utilized to mate with internal threads of a female-type screw-on type connector or a female-type plug-on connector. Male plug 302 also includes a shield 328 which selectively covers portions of plug body 310.

Plug body 310 includes a base 376 adjacent a proximal end 336 and a neck 378 adjacent a distal end 334. Plug body 310 also includes a lever 330 having a first end 332 connected to distal end 334 of plug body 310 and a second end 338 which extends from distal end 334 toward proximal end 336 and away from plug body 310. A pair of wings 340 extend outward from opposite sides of lever 330 adjacent first end 332. Preferably, lever 330 has a spring memory which enables second end 338 to return to a position in spaced relation with plug body 310 after being urged toward plug body 310. Lever 330 is configured to secure male plug 302 to a mating housing, e.g., female housing 304, in a manner known in the art.

Base 376 includes an aperture 339 having a mouth adjacent proximal end 336. Aperture 339 is configured to receive the end of tube 322 having first external male threads 324 therearound.

Ferrule 312 includes an axial bore 344 having a countersink 348 at one end thereof. Pin 314 has a body 342 which is received through bore 344 of ferrule 312. Adjacent one end thereof, pin 314 includes a head 346 which is received in countersink 348 of ferrule 312. Body 342 includes ribs 350 which interact with the walls of a bore 352 in plug body 310 when body 342 of pin 314 is received, e.g., press fit, into bore 352.

Conductive clip 318 has a proximal end 354 configured to be received in a bore 356 of pin 314 which extends partially through body 342 from head 346 toward a tip 358 of pin 314. Clip 318 has a distal end 360 which includes a plurality of fingers 362 configured to apply a spring bias toward a central axis 364 of clip 318. The configuration of clip 318, or any other clips disclosed herein, is not to be construed as limiting the invention.

Proximal end 354 of clip 318 is received in a bore 366 of collar 316. Collar 316 has a top surface 368 which abuts head 346 when it is received in countersink 348. As shown in FIG. 14*b*, bore 356 of pin 314 and bore 366 of collar 316 are aligned so that the proximal end 354 of clip 318 is received in bore 356 through bore 366.

The side of collar 316 opposite top surface 368 has a plurality of arms 370 configured to engage and align fingers 362 of clip 318 coaxially in sleeve 320. Collar 316 has a shoulder 372 around the proximal end of arms 370. Shoulder 372 and arms 370 are configured so that an end of sleeve 320 abuts shoulder 372 when arms 370 are received in sleeve 320.

Ferrule 312, collar 316 and sleeve 320 are inserted into tube 322 with ferrule 312 adjacent first external male threads 324 and with the end of sleeve 320 opposite collar 316 adjacent second external male threads 326. The first external male threads 324 of tube 322 are inserted through the mouth of aperture 339 and are rotatably threaded to female threads 374 formed on an inside wall of aperture 339.

Preferably, shield 328 is received on plug body 310. As shown in FIGS. 14*a* and 14*b*, shield 328 covers the top, bottom and sides of base 376 and the sides of neck 378.

Male plug 302 has a first cavity 380 which is defined by the inner surfaces of sleeve 320 and collar 316, and a second cavity 382 formed in neck 378 adjacent distal end 334. First cavity 380 has a mouth which opens toward the end of tube 322 and adjacent second external male threads 326. Second cavity 382 has a mouth which opens toward distal end 334 of plug body 310. Pin 314 and clip 318 collectively form a conductor 384 which is received in male plug 302. Conductor 384 has adjacent a first end 386 thereof a first section 388 received in first cavity 380. Conductor 384 also includes adjacent a second end 390 thereof a second section 392 received in second cavity 382. As discussed above, second external male threads 326 surrounding at least part of first cavity 380 have the form of a first fastener type 394. While conductor 384 is shown as having a separate pin 314 and clip 318, it is to be appreciated that conductor 384 can be of any form, especially a continuous piece having a pin and a clip at opposite ends thereof.

First section 388 of first conductor 384 is configured to electrically contact a conductive core 90 of coaxial cable 4 when coaxial cable 4 is mated with plug body 310 via the first fastener type 394. More specifically, as shown in FIG. 14*b*, first fastener type 394 has external male threads 326 which are configured to mate with internal female threads 396 of a female-type screw-on type connector 398 which is secured to coaxial cable 4 by a collar 400 which is received around insulating sheath 96 and which is electrically connected with shield 94 of coaxial cable 4 in a manner known in the art.

In order to promote electrical continuity between shield 328 of male plug 302 and shield 94 of coaxial cable 4, female-type screw-on type connector 398 and collar 400 are electrically conductive. Thus, when internal female threads 396 of female-type screw-on type connector 398 are rotatably received on second external male threads 326 of tube 322, electrical continuity is established between shield 94 of coaxial cable 4 and shield 328 of male plug 302 via collar 400, female-type screw-on type connector 398, and tube 322. To promote contact between shield 328 and tube 322, shield 328 includes one or more ribbons 404 configured to be sandwiched between base 376 of plug body 310 and tube 322.

Figure 14D:
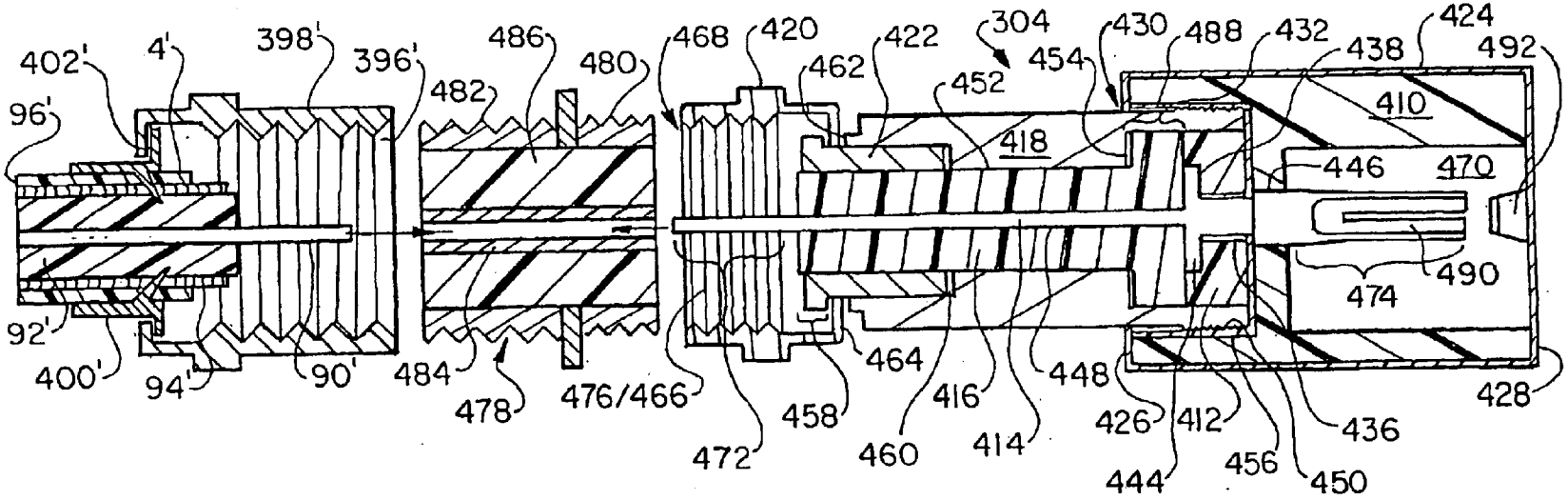
FIG. 14*d* is a cross section of the female housing in FIG. 14*a*, a cross section of a coaxial-to-coaxial interface, and a cross section of a coaxial cable and a screw-on type connector.
Figure 14E:
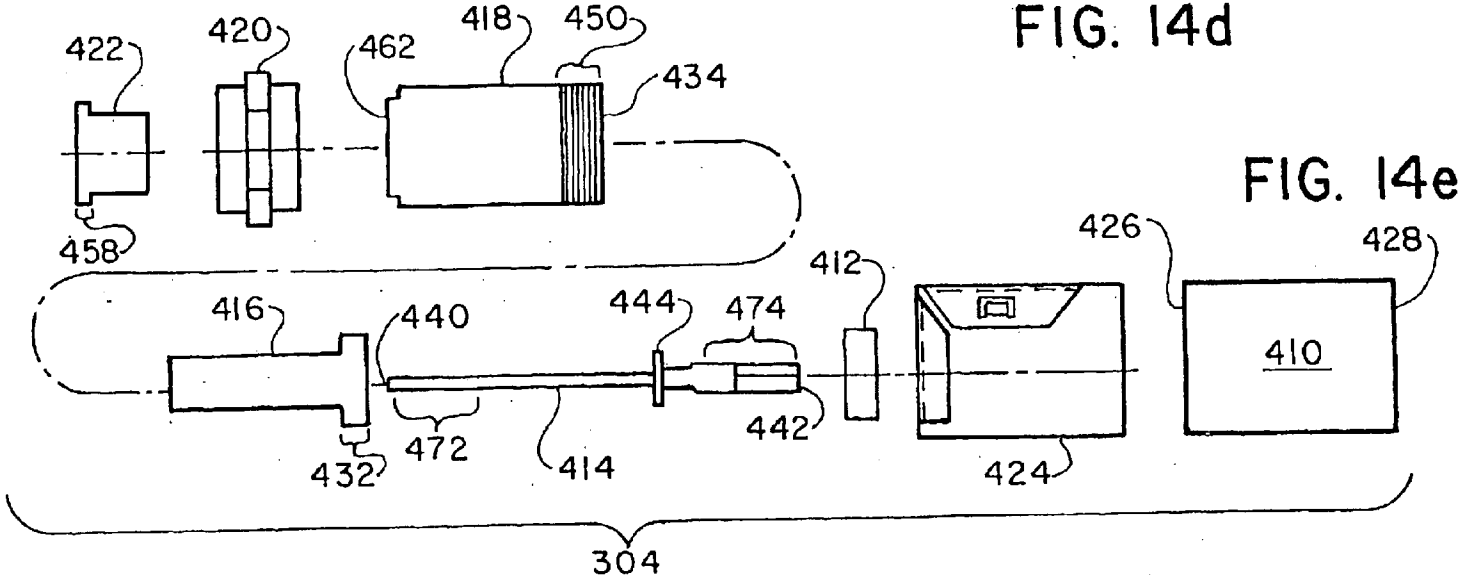
FIG. 14*e* is an exploded side view of the female housing in FIG. 14*a;*

Referring now to FIGS. 14*d* and 14*e*, and with ongoing reference to FIG. 14*a*, female housing 304 includes an insulating housing body 410, a conductive ferrule 412, a conductor 414, a flanged insulating sleeve 416, a conductive cylinder 418, a conductive internally threaded female-type screw-on type connector 420 and a conductive flanged collar 422. Female housing 304 also includes a conductive shield 424 configured to cover the top, bottom, sides and at least part of a proximal end 426 and a distal end 428 of housing body 410. Adjacent proximal end 426, housing body 410 includes an aperture 430 having a mouth configured to receive a distal end 434 of cylinder 418. Ferrule 412 includes an axial bore 436 having a countersink 438 at one end thereof and housing body 410 includes an axial bore 446 in communication with aperture 430.

Conductor 414 has a first end 440, a second end 442 and a flange 444 therebetween. Adjacent first end 440, conductor 414 has the form of an elongated pin 472. Adjacent second end 442, conductor 414 has the form of a clip 474. During assembly of female housing 304, second end 442 of conductor 414 is inserted through bore 436 of ferrule 412 until flange 444 is received in countersink 438. The projection of second end 442 of conductor 414 through ferrule 412 is also inserted through bore 446 of housing body 410. Next, the side of conductor 414 adjacent first end 440 is inserted into a bore 448 of sleeve 416 so that a head 432 at one end of sleeve 416 abuts flange 444 of pin 414 received in countersink 438 of ferrule 412. Cylinder 418 includes external male threads 450 adjacent distal end 434. Adjacent distal end 434, cylinder 418 is configured to receive head 432 of sleeve 416 and ferrule 412. Opposite head 432, sleeve 416 extends through cylinder 418 and terminates proximally of proximal end 462 of cylinder 418. When ferrule 412 and sleeve 416 are received in cylinder 418, external male threads 450 of cylinder 418 are rotatably threaded with internal female threads 456 formed on an inside wall of aperture 430. When external male threads 450 of cylinder 418 and internal female threads 456 of housing body 410 are threadedly mated, a shoulder 454 of cylinder 418 abuts a side of flange 432 opposite ferrule 412, thereby securing cylinder 418, sleeve 416, ferrule 412 and conductor 414 to housing body 410.

Collar 422 includes a flange 458 adjacent one end thereof. The end of collar 422 opposite flange 458 is received in an annular slot 460 formed between sleeve 416 and cylinder 418 adjacent a proximal end 462 of cylinder 418. At one end thereof, female-type screw-on type connector 420 includes a ring-like flange 464 having an inside diameter received in a gap between flange 458 of sleeve 422 and proximal end 462 of cylinder 418. A side of female-type screw-on type connector 420 opposite flange 464 has the form of a second fastener type 466, preferably having internal female threads 476.

Female housing 304 has first cavity 468 defined by the inside diameter of female-type screw-on type connector 420, and a second cavity 470 formed in housing body 410. The mouth of second cavity 470 opens toward distal end 428 of housing body 410. When cylinder 418 is threadedly mated with housing body 410, the section of elongated pin 472 adjacent first end 440 of conductor 414 is received within first cavity 468 and the section of clip 474 adjacent second end 442 of conductor 414 is received within second cavity 470.

Pin 472 of conductor 414 is configured to be electrically connected with conductive core 90' of coaxial cable 4' when coaxial cable 4' is mated with female housing 304 via second fastener type 466. More specifically, a coaxial-to-coaxial interface 478 is utilized to electrically connect conductor 414 and female-type screw-on type connector 420 with conductive core 90' and shield 94' of coaxial cable 4'. Coaxial-to-coaxial interface 478 includes conductive external male threads 480 and 482 adjacent opposite ends thereof, an axial conductive cylinder 484 and an insulating jacket 486 between conductive cylinder 484 and external male threads 480 and 482. External male threads 480 are configured to mate with internal female threads 476 of second fastener type 466 of female-type screw-on type connector 420, and external male threads 482 are configured to mate with internal female threads 396' of a female-type screw-on type connector 398'. When external male threads 480 and the internal female threads of second fastener type 466 are mated, first end 440 of conductor 414 is received in one end of conductive cylinder 484 of coaxial-to-coaxial interface 478. Similarly, when external male threads 482 are mated with internal female threads 396', conductive core 90' of coaxial cable 4' is received in the other end of conductive cylinder 484. Electrical continuity is established between shield 94' of coaxial cable 4' and shield 424 of female housing 304 via collar 400', female-type screw-on type connector 398', external male threads 480 and 482, female-type screw-on type connector 420, collar 422 and cylinder 418. To promote electrical contact with cylinder 418, shield 424 includes one or more ribbons 488 which are sandwiched between cylinder 418 and housing body 410 adjacent external male threads 450 of cylinder 418.

With specific reference to FIGS. 14*a*, 14*b* and 14*d*, neck 378 of male plug 302 is configured to be received through the mouth of second cavity 470 of female housing 304. Clip 474 has a plurality of fingers 490 which extend in spaced relation toward the mouth of second cavity 470. Fingers 490 are configured to receive and grip second section 392 of conductor 384 when neck 378 of male plug 302 is received in second cavity 470. To promote electrical contact with shield 328 of male plug 302 when neck 378 is received in second cavity 470, shield 424 includes one or more conductive tabs 492 for contacting one or both sides of shield 328 covering the sides of neck 378. Thus, when male plug 302 and female housing 304 are mated, and when coaxial cables 4 and 4' are connected via first fastener type 394 and second fastener type 466, electrical continuity is established between conductive cores 90 and 90' and shields 94 and 94' of coaxial cables 4 and 4', respectively.

With ongoing reference to FIG. 14*a*, shield 328 of male plug 302 does not cover the top surface of neck 378 of plug body 310. However, when neck 378 is received in second cavity 470 of female housing 304, the portion of shield 424 covering the top surface of housing body 410 also covers the top surface of neck 378. It is to be appreciated that male plug 302 and female housing 304 are configured to be connected to conventional coaxial cable connectors via fastener means well-known in the art, e.g., coaxial-to-coaxial interface 478, and the combination of female-type screw-on type connector 398 or 398' and collar 400 or 400', as shown in FIGS. 14*b* and 14*d*.

Figures 15A, 15B:
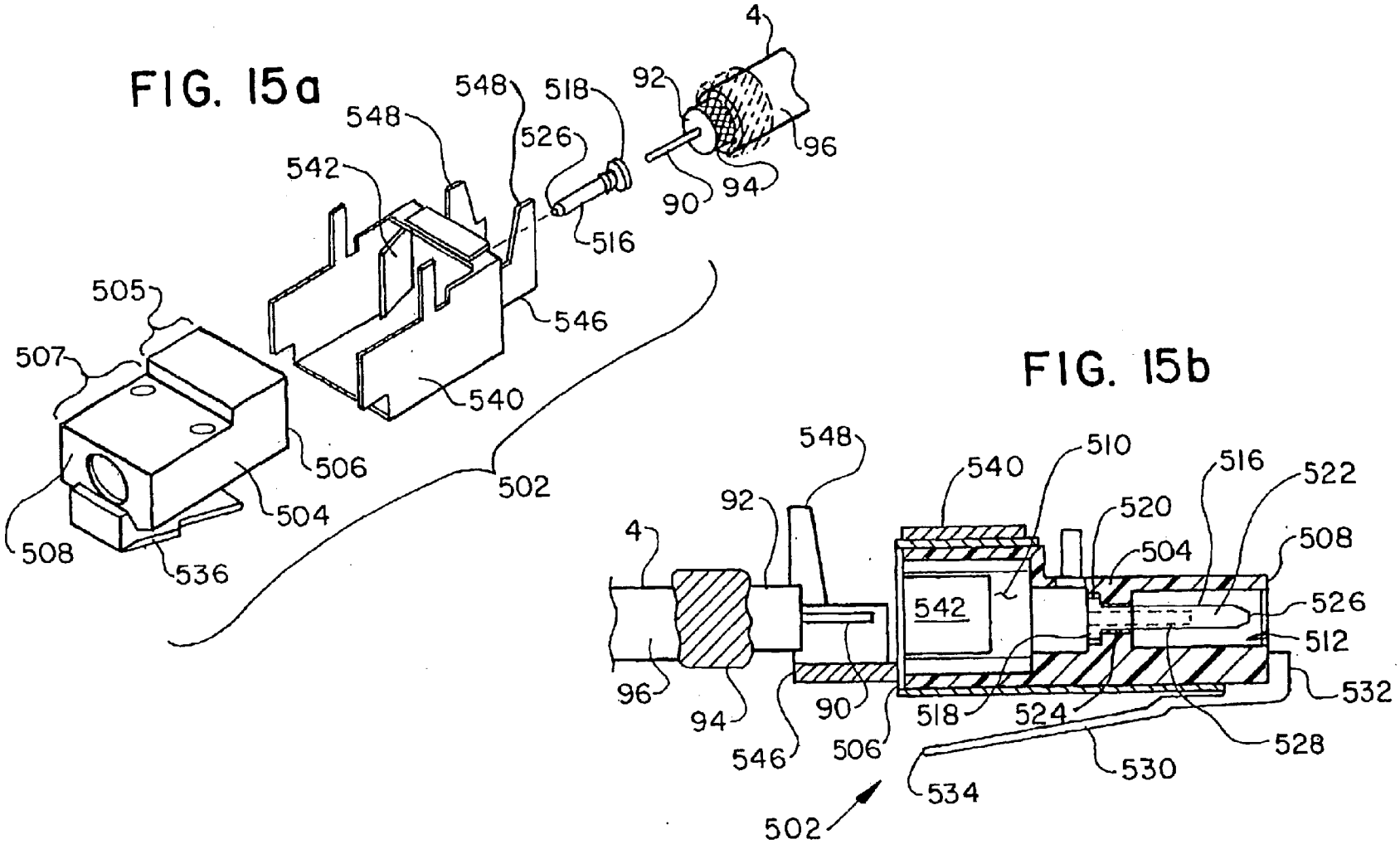
FIG. 15*a* is an exploded perspective view of a male plug in accordance with another embodiment of the present invention.
FIG. 15*b* is an assembled sectional view of the male plug in FIG. 15*a;*

With reference to FIGS. 15*a* and 15*b*, another embodiment of RJ type coaxial cable connector 2 includes a male plug 502 having an insulating plug body 504 with a base 505 adjacent a proximal end 506 and a neck 507 adjacent a distal end 508. Male plug 502 has a first cavity 510 in base 505 and a second cavity 512 in neck 507. First cavity 510 has a mouth which opens toward proximal end 506 of plug body 504 and second cavity 512 has a mouth which opens toward distal end 508 of plug body 504.

Plug body 504 includes an axial bore 524 in communication with first cavity 510 and second cavity 512. Adjacent first cavity 510, bore 524 includes a countersink 520. First cavity 510 is configured to receive coaxial cable 4 therein. Male plug 502 includes a conductive pin 516 having a flange 518 and a tip 526 at opposite ends of a body 522. Flange 518 is configured to be received in countersink 520 when body 522 of pin 516 is inserted into bore 524 of plug body 504. Preferably, when pin 516 is inserted into bore 524, tip 526 and the portion of body 522 adjacent tip 526 are received in second cavity 512. Pin 516 has a bore 528 (shown in phantom) which extends in body 522 from flange 518 toward tip 526.

Male plug 502 includes a lever 530 having a first end connected to distal end 508 of plug body 504 adjacent second cavity 512, and a second end 534 which extends from distal end 508 toward proximal end 506 and away from plug body 504. A pair of wings 536 extend outward from opposite sides of lever 530. Lever 530 has a spring memory which enables second end 534 to return to a position in spaced relation with plug body 504 after being urged toward plug body 504. Lever 530 is configured to secure male plug 502 to a mating housing, e.g., female housing 304 in FIG. 14*a*, in a manner known in the art.

Between countersink 520 and proximal end 506, plug body 504 is configured to receive insulating jacket 92, shield 94 and insulating sheath 96 adjacent the exposed core 90 of coaxial cable 4. More specifically, insulating jacket 92 has been stripped to expose a section of conductive core 90, and insulating sheath 96 has been stripped to expose a section of shield 94 surrounding insulating jacket 92. As shown in phantom in FIG. 15*a*, prior to inserting coaxial cable 4 into first cavity 510, shield 94 is folded back on itself so that it covers insulating sheath 96 adjacent the exposed section of insulating jacket 92.

Male plug 502 includes a shield 540 which is configured to cover the bottom and sides of plug body 504 and at least part of the top of base 505. In the embodiment shown in FIGS. 15*a* and 15*b*, however, shield 540 does not cover the top of neck 507. However, this is not to be construed as limiting the invention. Shield 540 includes one or more tabs 542 which extend from proximal end 506 of plug body 504 into first cavity 510 when shield 540 is received on plug body 504.

Prior to inserting pin 516 into bore 524 of plug body 504, conductive core 90 is inserted into bore 528 of pin 516. Thereafter, the body of pin 516 adjacent bore 528 is crimped onto conductive core 90. Next, pin 516 is inserted into bore 524 with tip 526 and the portion of body 522 adjacent tip 526 received in second cavity 512, and with flange 518 received in countersink 520. Since conductive core 90 is crimped to pin 516, when pin 516 is inserted into bore 524, the terminal end of insulating sheath 96 adjacent the exposed end of conductive core 90 is received in first cavity 510 with the folded back section of shield 94 sandwiched between insulating sheath 96 and tabs 542. Electrical conductivity is established between shield 94 of coaxial cable 4 and shield 540 of male plug 502 via tabs 542 in contact with shield 94. Preferably, the section of first cavity 510 adjacent countersink 520 is configured to snugly receive the exposed portion of insulating jacket 92 while the section of first cavity 510 adjacent proximal end 506 is configured to snugly receive insulating sheath 96 and shield 94.

Adjacent tabs 542, shield 540 preferably includes a U-shaped cable support 546 having a pair of upwardly extending and offset ears 548. When coaxial cable 4 is received in first cavity 510, ears 548 and the base of cable support 546 are crimped around insulating sheath 96 of coaxial cable 4. Crimping coaxial cable 4 in this manner avoids withdrawal of coaxial cable 4 from first cavity 510.

Figure 16B:
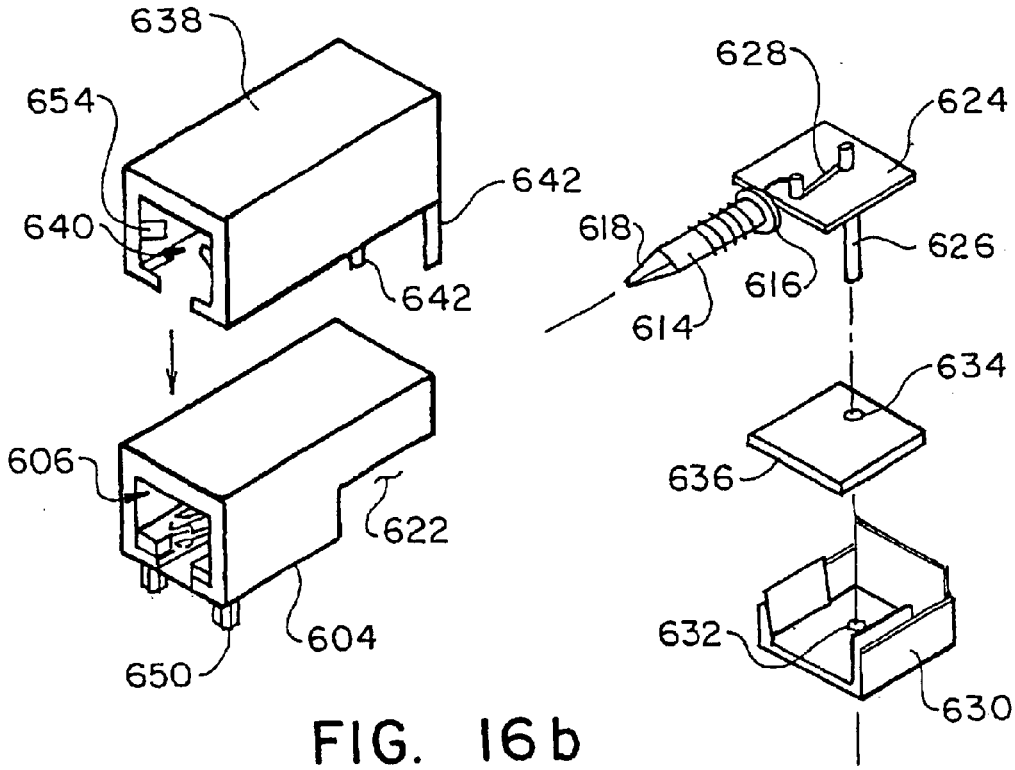
FIG. 16*b* is an exploded view of the female housing in FIG. 16*a;*
Figure 16A:
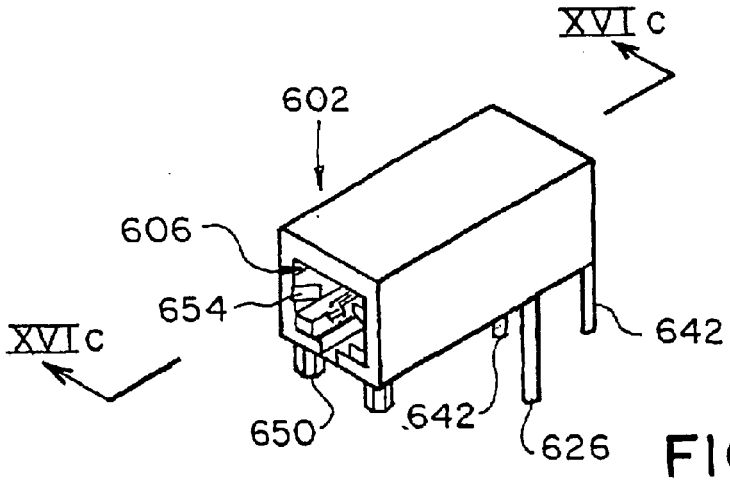
FIG. 16*a* is a perspective view of an RJ type PCB coaxial cable female housing in the form of a common RJ type connector in accordance with another embodiment of the present invention.
Figure 16C:
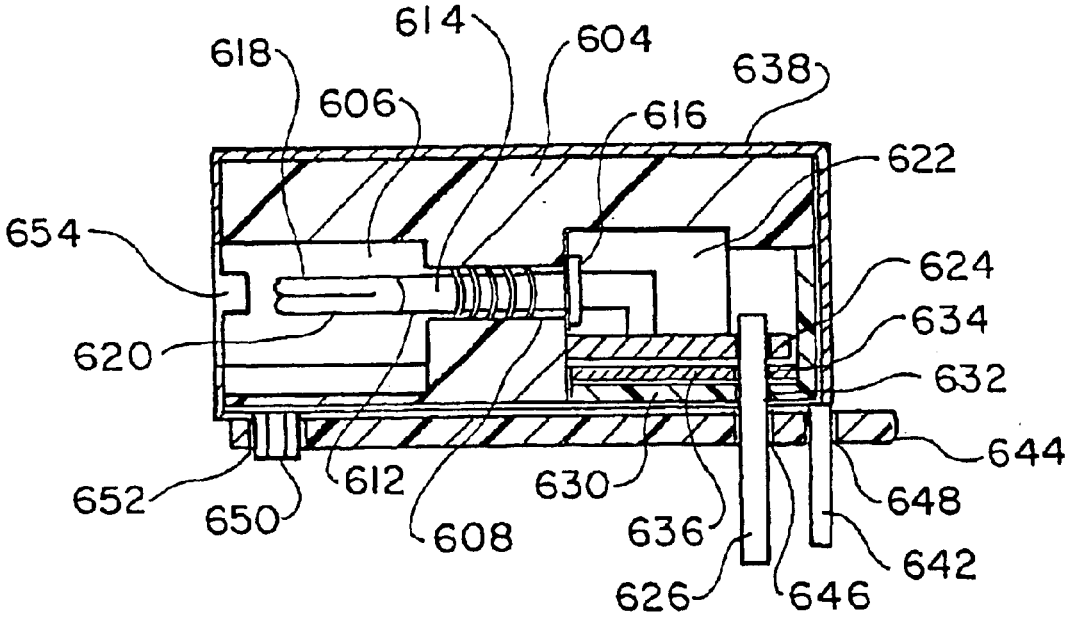
FIG. 16*c* is a cross section taken along lines XVIc—XVIc in FIG. 16*a;*

With reference to FIGS. 16*a*–16*c*, another embodiment of RJ type coaxial cable connector 2 includes a female housing 602 having an insulating housing body 604 with a cavity 606 adjacent one end of housing body 604, a bore 608 in communication with cavity 606, and a conductive L-shaped pin 612. A side of housing body 604 opposite cavity 606 defines a recess 622 through which pin 612 passes during insertion of pin 612 into bore 608. Pin 612 has a body 614 received in bore 608 with a head 616 abutting an end of bore 608 opposite cavity 606. One end of pin 612 has the form of a clip 618 which is received in cavity 606. Clip 618 has a plurality of fingers 620 which extend toward the mouth of cavity 606. The other end of pin 612 terminates on an insulating substrate, such as a printed circuit board (PCB) 624. A pin 626 is connected to PCB 624 and one or more printed circuit leads 628 formed on PCB 624 electrically connect pin 626 and pin 612.

Female housing 602 includes a cover 630 configured to cover recess 622. Cover 630 includes a hole 632 therein for receiving the projection of pin 626 therethrough. Preferably, a ferrite block 636 is received between cover 630 and PCB 624. Ferrite block 636 includes a hole 634 which is aligned with hole 632 in cover 630 so that pin 626 projects through hole 634. Preferably, hole 634 in ferrite block 636 is of sufficient size to avoid contact pin 626 projecting therethrough. Ferrite block 636 acts to filter unwanted radio frequency (RF) noise superimposed on signals propagating on the portions of pins 612 and 626 received in recess 622.

Female housing 602 includes a conductive shield 638 having an aperture 640 adjacent one end thereof. Shield 638 is configured to cover the top, sides and back of housing body 604 and the back of cover 630 when it is mated to housing body 604. When shield 638 is received on housing body 604, aperture 640 is aligned with the mouth of cavity 606. Shield 638 also includes one or more conductive shield pins 642 which extend parallel with pin 626 away from the bottom of female housing 602.

Female housing 602 is configured to be received on a PCB 644 which includes plated through-holes 646 and 648 for receiving pin 626 and one of pins 642, respectively, each plated through-hole 645 and 648 is electrically connected to a conductive trace (not shown) disposed on PCB 644 in a manner known in the art. A solder (not shown) is preferably introduced between pin 626 and through hole 646, and between each shield pin 642 received in a through-hole 648 to promote electrical contact therebetween.

With reference back to FIGS. 15*a* and 15*b*, and with continuing reference to FIGS. 16*a*–16*c*, cavity 606 of female housing 602 is configured to receive and mate with neck 507 of male plug 502. When neck 507 of male plug 502 is received in cavity 606 of female housing 602, the section of pin 516 adjacent tip 526 is received within fingers 620 of clip 618 thereby establishing electrical continuity between pin 516 and pin 612. To promote electrical contact between shield 638 of female housing 602 and shield 540 of male plug 502, shield 638 has one or more tabs 654 which extend into cavity 606. When male plug 502 is mated with female housing 602, each tab 654 contacts a side of shield 540 thereby establishing electrical continuity between shield 638 and shield 94 of coaxial cable 4.

Figure 17C:
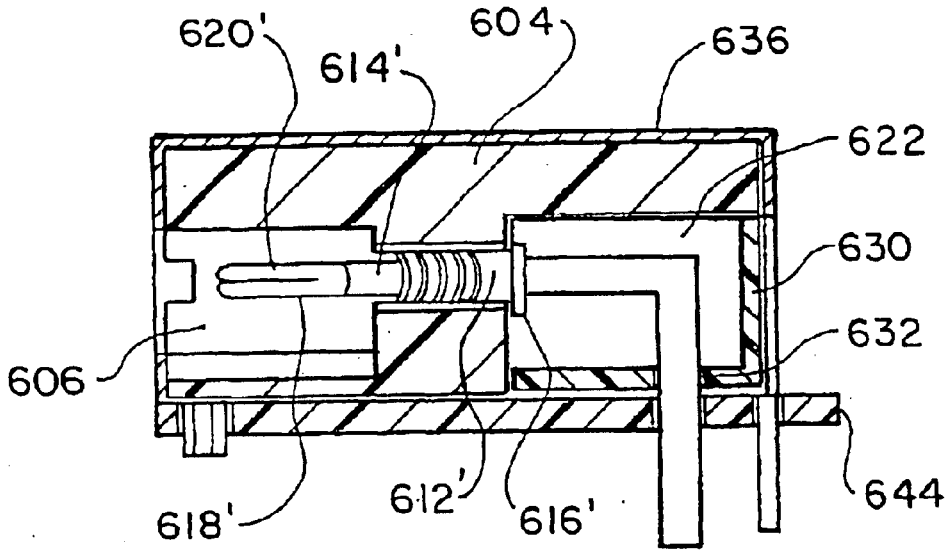
FIG. 17*c* is a cross section taken along lines XVIIc—XVIIc in FIG. 17*a;*
Figure 17B:
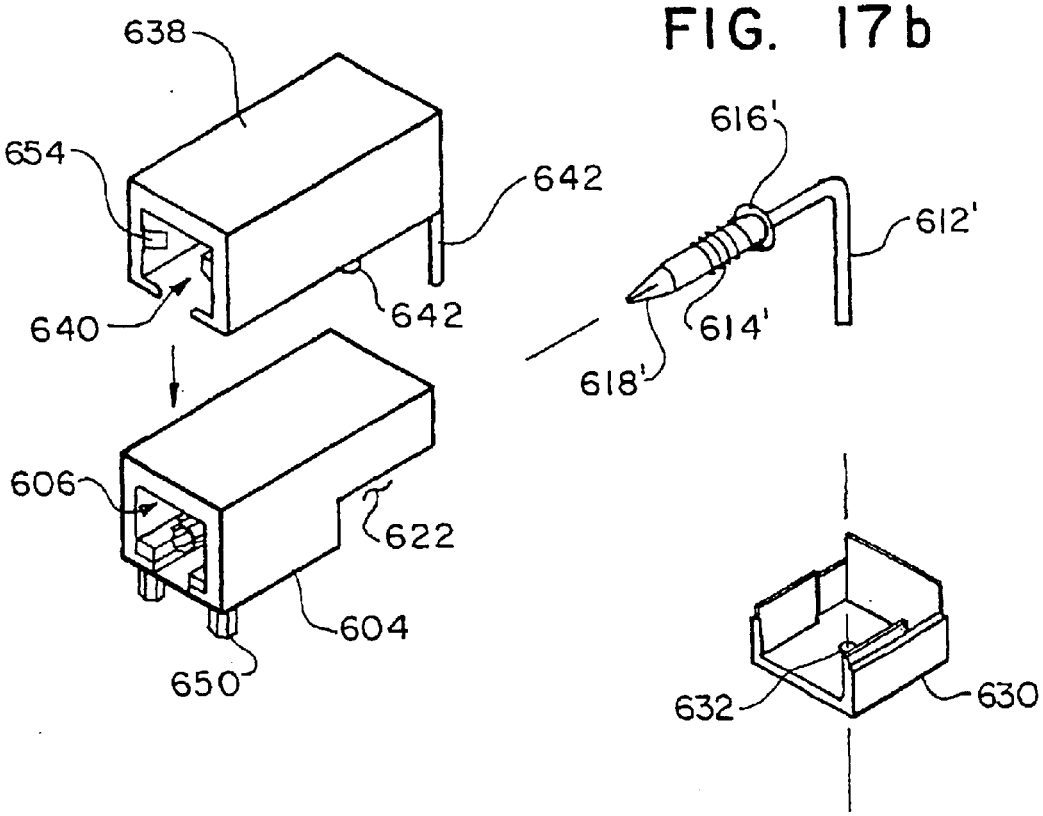
FIG. 17*b* is an exploded view of the female housing shown in FIG. 17*a;*
Figure 17A:
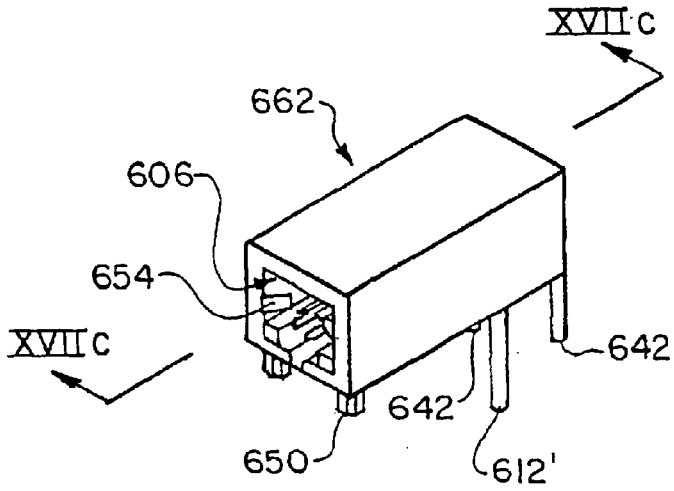
FIG. 17*a* is a perspective view of an RJ type PCB coaxial cable female housing in the form of a common RJ type connector in accordance with another embodiment of the present invention.

With reference to FIGS. 17*a*–17*c*, another embodiment of RJ type coaxial cable connector 2 includes a female housing 662 having the housing body 604, the cover 630 and the shield 638 as shown in FIGS. 16*a*–16*c*. In addition, female housing 662 includes a conductive L-shaped pin 612'. Pin 612' has a body 614' received in bore 608 with a flange 616' abutting an end of bore 608 opposite cavity 606. One end of pin 612' is received in cavity 606 and has the form of a clip 618 with a plurality of fingers 620' which extend in spaced relation toward the mouth of cavity 606. The other end of pin 612' passes directly through through-hole 632, thereby avoiding the use of pin 626 and PCB 624 as an interface between pin 612' and PCB 644.

Figure 18A:
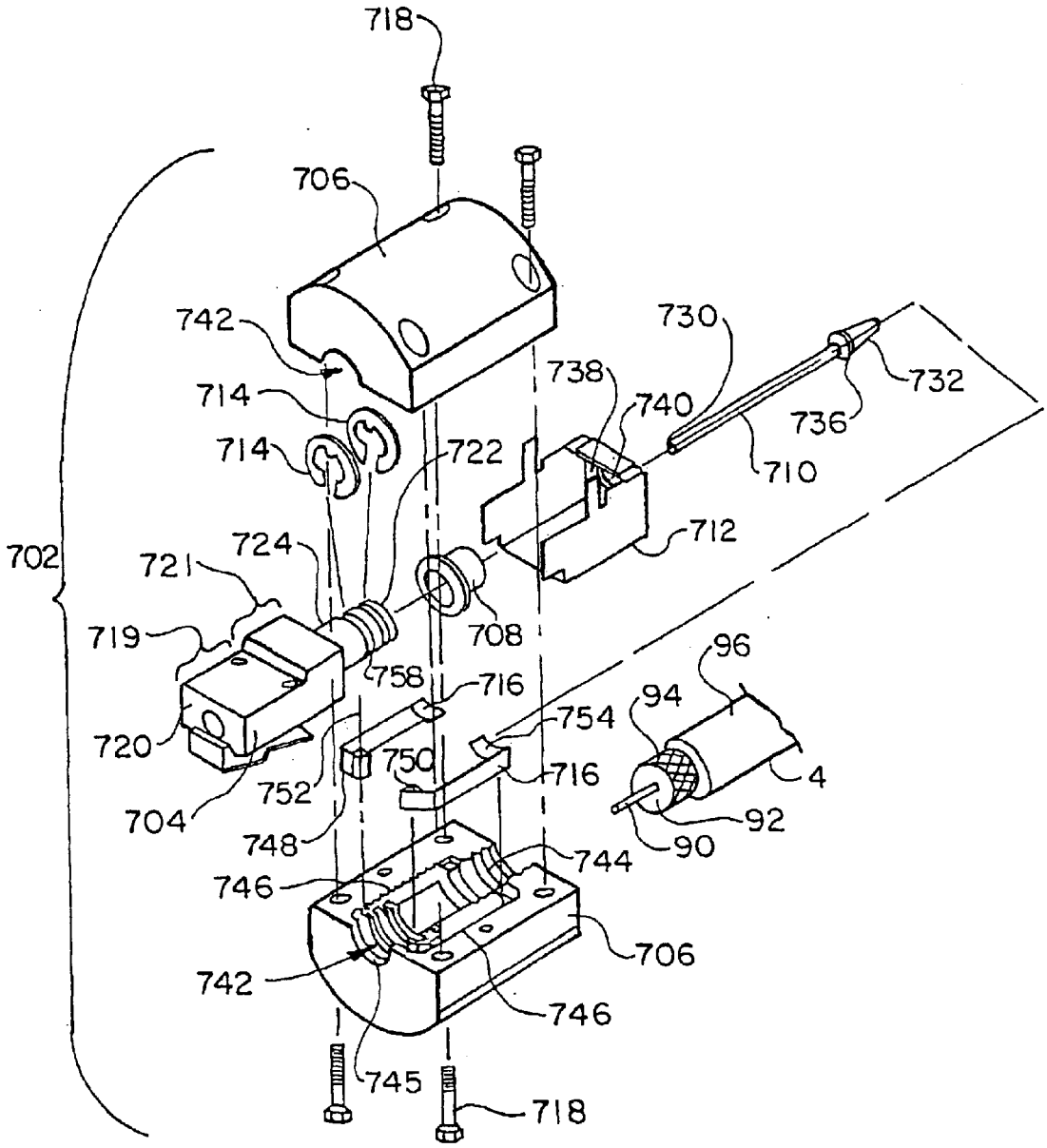
FIG. 18*a* is an exploded perspective view of an RJ type male plug in accordance with another embodiment of the present invention.
Figure 18B:
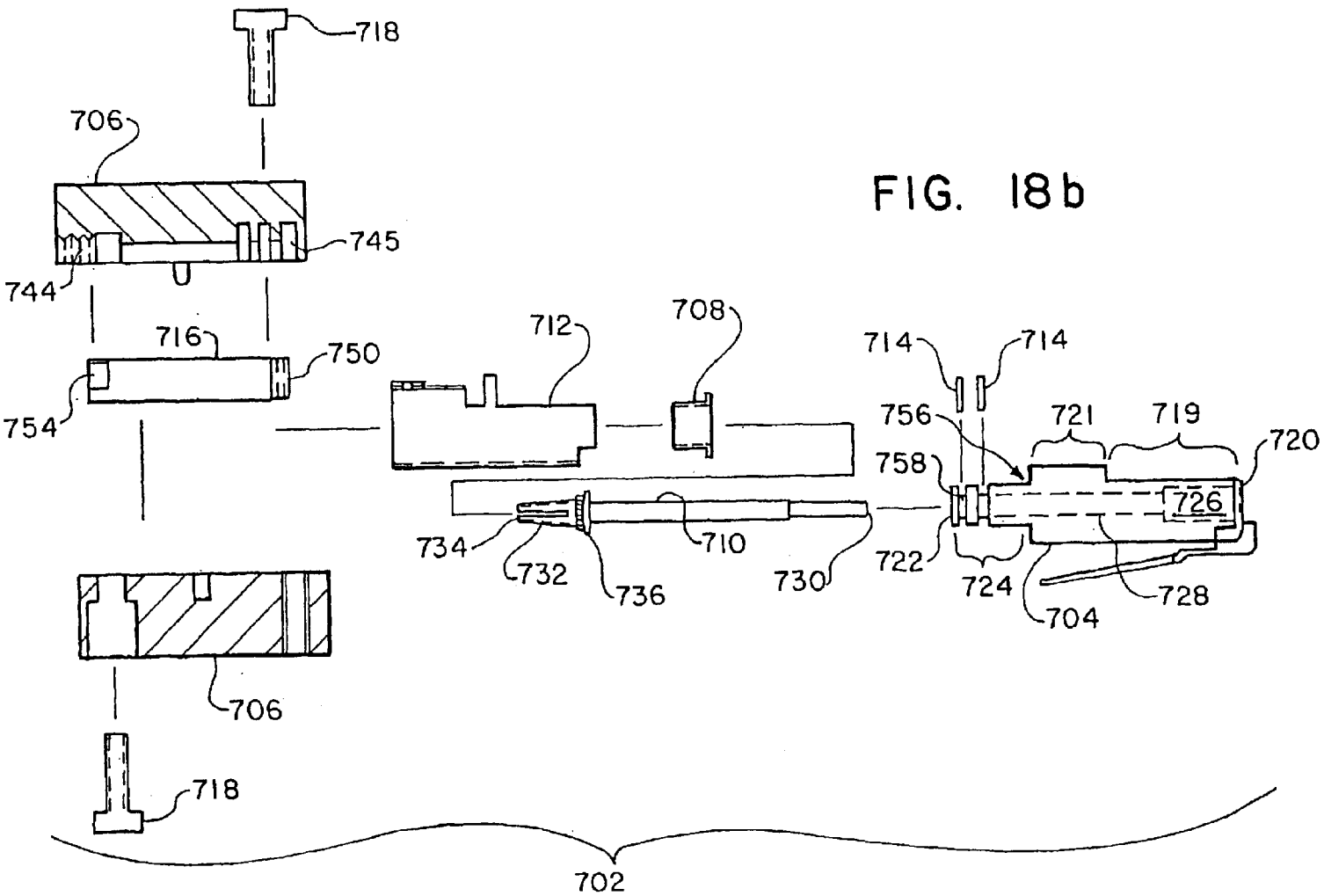
FIG. 18*b* is an exploded partial sectional view of the RJ type male plug shown in FIG. 18*a;*

With reference to FIGS. 18*a* and 18*b*, another embodiment of RJ type coaxial cable connector 2 includes a male plug 702 having an insulating plug body 704, a pair of insulating arcuate-shaped enclosures 706, a conductive flanged collar 708, a conductive pin 710, a conductive shield 712, a pair of C-rings 714, a pair of conductive leaf spring contacts 716 and fasteners 718.

Plug body 704 includes a neck 719 adjacent a distal end 720, and a base 721 intermediate distal end 720 and a proximal end 722 of plug body 704. Between base 721 and proximal end 722, plug body 704 has the form of a cylinder 724. Neck 719 of plug body 704 includes a cavity 726 adjacent distal end 720. Plug body 704 has a bore 728 which extends through plug body 704 from proximal end 722 through cylinder 724 to cavity 726.

Pin 710 has a tip 730 and a clip 732 at opposite ends thereof and a flange 736 therebetween. Clip 732 has a plurality of fingers 734 which extend in spaced relation away from flange 736.

Shield 712 has essentially the same configuration as shield 540 in FIG. 15*a* absent U-shaped cable support 546, but including an end plate 738 having therein a hole 740 configured to receive cylinder 724 of plug body 704.

Each enclosure 706 defines an arcuate channel 742 having a plurality of inwardly extending ribs 744 and 745 adjacent opposite ends thereof. Each enclosure 706 also includes a pair of slots 746 which extend parallel to channel 742 on opposite sides thereof. Each slot 746 is configured to receive the side of a leaf spring contact 716 therein. When the pair of enclosures 706 is mated together, their respective channels 742 coact to form a circular channel which extends between opposite ends of the pair of enclosures 706.

Each contact 716 has a pair of sides configured to be received in opposing slots 746 when the pair of enclosures 706 is mated together. One end of each contact 716 includes an arm 748 which extends inwardly toward channel 742 when the contact 716 is received in slot 746. Each arm 748 terminates in an arc or cylinder 750 having a radial axis 752 which extends transverse, preferably perpendicular, to the longitudinal axis of channel 742. Adjacent the other end of each contact 716 a leaf 754 extends inwardly toward the longitudinal axis of channel 742 when contact 716 is received in slot 746.

Pin 710 is received through bore 728 so that a section of pin 710 adjacent tip 730 is received in cavity 726, flange 736 abuts proximal end 722 of plug body 704 and clip 732 extends away from proximal end 722. Flanged collar 708 is received over cylinder 724 with the flanged side of collar 708 abutting base 721 of plug body 704. Next, shield 712 is received on plug body 704 with cylinder 728 projecting through hole 740 in end plate 738 and with the flange of collar 708 sandwiched between base 721 and end plate 738. C-rings 714 are then inserted in annular slots 758 formed in cylinder 724 adjacent proximal end 722 of plug body 704.

Conductive core 90 of coaxial cable 4 is inserted between fingers 734 of clip 732. Next, cylinder 724, the body of collar 708 and coaxial cable 4 are received in channel 742 of one of enclosures 706 with a surface of end plate 738 of shield 712 opposite the flange of collar 708 abutting an end of enclosure 706. Ribs 745 of plug body 704 are configured to receive the projection of C-rings 714 from annular slots 758 therebetween when cylinder 724 is received in channel 742.

Contacts 716 are received in their respective slots 746 so that the arc or cylinders 750 contact the body of collar 708 and the leafs 754 contact conductive shield 94 of coaxial cable 4. Coaxial cable 4 is received sufficiently in channel 742 so that ribs 744 contact insulating sheath 96. Lastly, enclosures 706 are mated and secured together by fasteners 718. Ribs 744 are configured to clamp insulating sheath 96 when enclosures 706 are secured together with coaxial cable 4 therebetween. Clamping coaxial cable 4 in this manner avoids withdrawal of coaxial cable 4 from between the pair of mated enclosures 706.

In this embodiment, plug body 704 and shield 712 are rotatable relative to the pair of enclosures 706 around the axis of bore 728. Electrical contact is established between shield 712 and conductive shield 94 of coaxial cable 4 via contact between end plate 738, collar 708 and contacts 716.

Figure 19B:
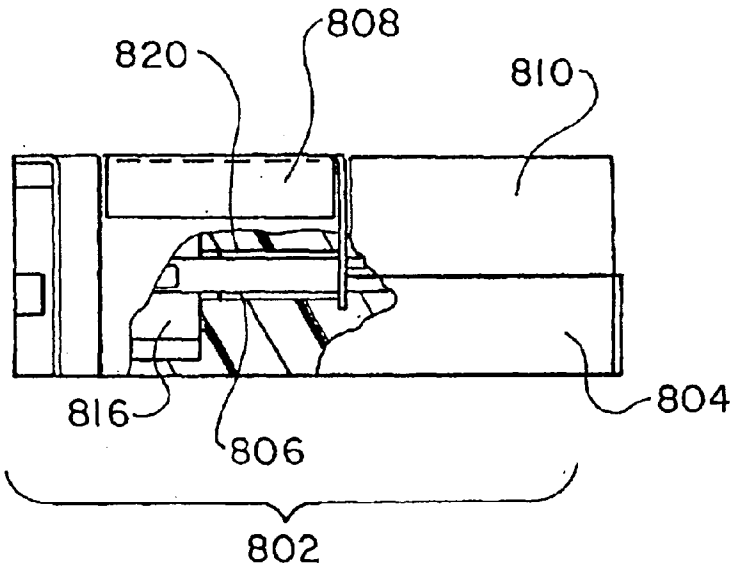
FIG. 19*b* is an assembled partial sectional side view of the female housing shown in FIG. 19*a;*
Figure 19A:
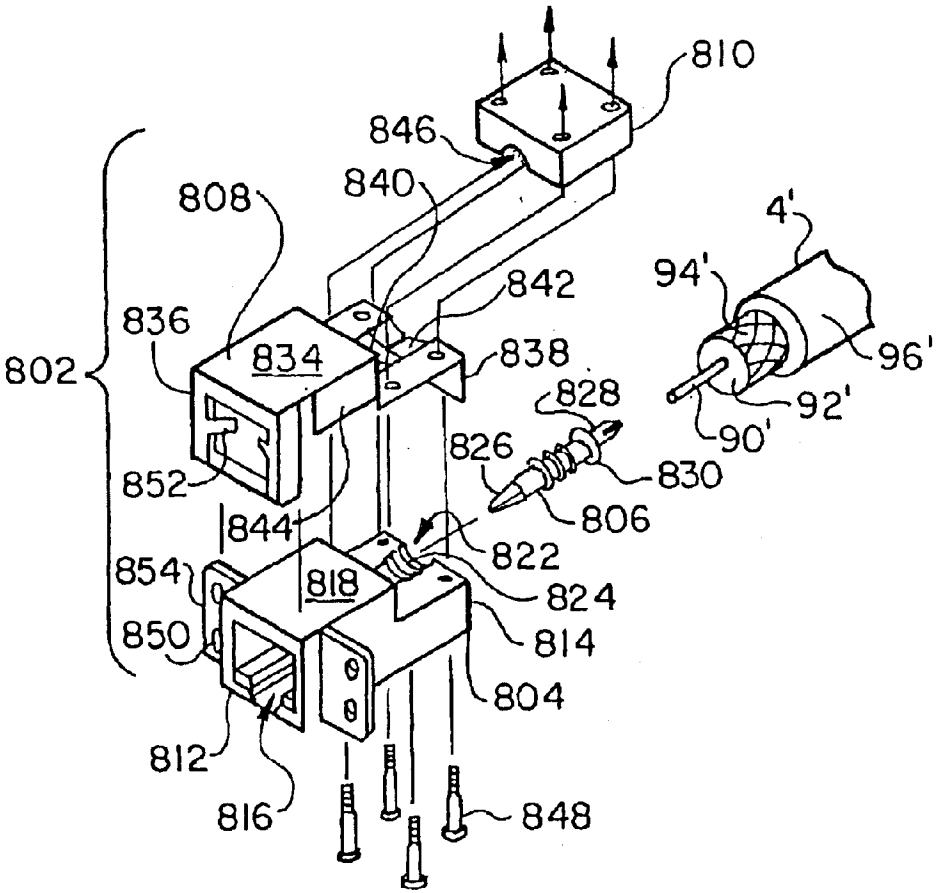
FIG. 19*a* is an exploded perspective view of an RJ type female housing in accordance with another embodiment of the present invention.

With reference to FIGS. 19*a* and 19*b*, another embodiment of RJ type coaxial cable connector 2 includes a female housing 802 having an insulating housing body 804, a conductive pin 806, a conductive shield 808 and an insulating cover 810. Housing body 804 has a first end 812, a second end 814 and a cavity 816 adjacent first end 812. Between first end 812 and second end 814, a top surface 818 of housing body 804 stairsteps downward. Housing body 804 includes a bore 820 extending between cavity 816 and the lower part of the stairstep of top surface 818 adjacent second end 814. The lower part of the stairstep of top surface 818 adjacent second end 814 also includes a channel 822 which is aligned axially with the lower part of bore 820. Adjacent second end 814, channel 822 enlarges and includes inwardly extending ribs 824.

Pin 806 includes a pair of clips 826 and 828 at opposite ends thereof and a flange 830 therebetween. Shield 808 has a top surface 834 that stairsteps downward between a first end 836 and a second end 838 of shield 808. The portion of top surface 834 adjacent second end 838 has a slot 840 which extends from second end 838 toward the vertical surface of the stairstep of top surface 834. The vertical surface of the stairstep of top surface 834 includes a slot or hole (not shown) for receiving pin 806 therethrough. This slot or hole is of sufficient size so that flange 830 of pin 806 contacts the vertical surface of the stairstep of top surface 818 of housing body 804, but does not contact the vertical surface of the stairstep of top surface 834 of shield 808. Adjacent second end 838, shield 808 includes a pair of leafs 842 which extend from opposite sides of slot 840 toward each other. Shield 808 also includes a pair of sides 844 which extend downwardly from top surface 834 for partially covering the sides of housing body 804 when shield 808 is received thereon. Lastly, a first end 836 of shield 808 is configured to cover the mouth of cavity 816.

Cover 810 is configured to be received over the portion of top surface 834 adjacent second end 838 when shield 808 is received on housing body 804. Cover 810 includes an arcuate channel 846 which when placed in opposition to channel 822 forms a generally cylindrical aperture for receiving coaxial cable 4' therein.

When female housing 802 is assembled, shield 808 is received on housing body 804 and the end of pin 806 having clip 826 thereon is inserted into bore 820 so that clip 826 is received in cavity 816 and flange 830 abuts the vertical wall of the stairstep of top surface 818. Conductive core 90' of coaxial cable 4' is inserted into clip 828 of pin 806 with conductive shield 94' of coaxial cable 4' contacting leafs 842. Cover 810 is then received over the part of top surface 834 of shield 808 adjacent second end 838 with channel 846 aligned with channel 822. Cover 810 and housing body 804 are secured together by fasteners 848. Securing cover 810 and housing body 804 together clamp coaxial cable 4', and more specifically, conductive shield 94' and insulating jacket 92' between cover 810 and housing body 804. Clamping coaxial cable 4' in this manner avoids withdrawal of conductive core 90' from clip 828.

In the embodiment of RJ type coaxial cable connector 2 shown in FIGS. 19*a* and 19*b*, housing body 804 includes flanges 854 which extend from opposite sides thereof. Each flange 854 includes one or more holes 850 for receiving a fastener for mounting female housing 802 to a wall or other flat surface.

Cavity 816 is configured to receive the neck of a male plug, such as neck 719 of male plug 702 in FIG. 18*a*. When male plug 702 is mated with female housing 802, tip 730 of pin 710 received in cavity 726 is received between the fingers of clip 826 of female housing 802, thereby establishing continuity between conductive cores 90 and 90' of coaxial cables 4 and 4', respectively. To promote electrical contact between conductive shields 94 and 94' of coaxial cables 4 and 4', respectively, shield 834 includes tabs 852 which extend inwardly into cavity 816 for contacting the sides of shield 712 when male plug 702 is mated with female housing 802.

Figure 21:
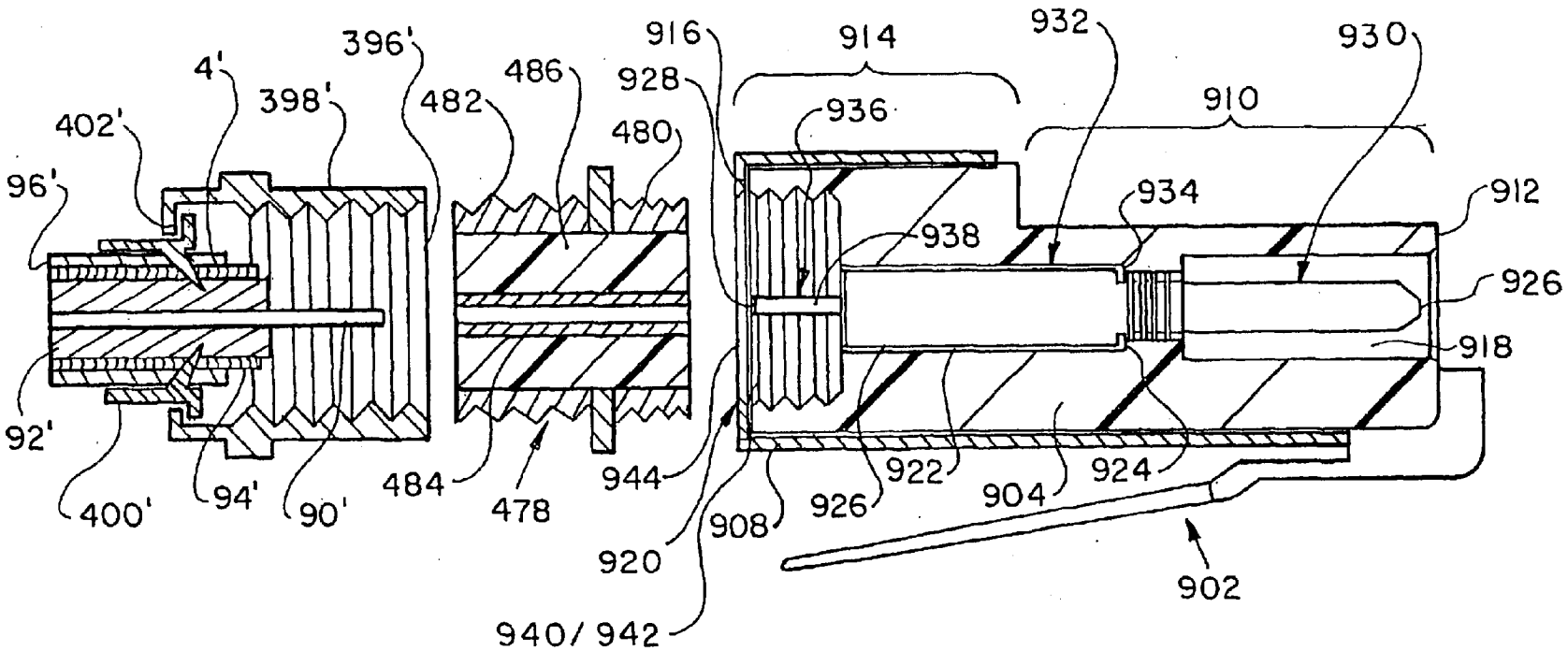
FIG. 21 is a cross section of a male plug in accordance with another embodiment of the present invention, a cross section of a coaxial-to-coaxial interface, and a cross section of a coaxial cable and screw-on type connector.

With reference to FIG. 21, another embodiment of RJ type coaxial cable connector 2 includes a male plug 902 having an insulating plug body 904, a conductive pin 906 and a conductive shield 908. Plug body 904 includes a neck 910 adjacent a distal end 912 and a base 914 adjacent a proximal end 916. Plug body 904 includes a first cavity 918 formed in neck 910 adjacent distal end 912 and a second cavity 920 formed in base 914 adjacent proximal end 916. Between first cavity 918 and second cavity 920, plug body 904 includes a bore 922 having a shoulder 924 adjacent first cavity 918. Between shoulder 924 and first cavity 918, bore 922 has a smaller diameter than the section of bore 922 between shoulder 924 and second cavity 920.

Pin 906 has tips 926 and 928 at opposite ends thereof. Adjacent tip 926, pin 906 includes a first section 930 configured to be inserted through bore 922 and received in first cavity 918. Pin 906 also includes a second section 932 having at one end thereof adjacent first section 930 a shoulder 934 configured to abut shoulder 924 of bore 922 when pin 906 is inserted into bore 922. Lastly, adjacent tip 928, pin 906 includes a third section 936 in the form of a conductive core 938 of a conventional coaxial cable. The inside surface of second cavity 920 has the form of a second fastener type 940, preferably having internal female threads 942. Third section 936 of pin 906 is received in second cavity 920.

Third section 936 of pin 906 is configured to be electrically connected with conductive core 90' of coaxial cable 4' when coaxial cable 4' is mated with male plug 902 via second fastener type 940.

Shield 908 is configured to be received on plug body 904 and to cover the sides and bottom of plug body 904 and the top surface of base 914 of plug body 904 in the same manner as shield 328 covers plug body 310 of male plug 302 in FIG. 14*a*.

Pin 906 and shield 908 are configured to be electrically connected with conductive core 90' and shield 94'of coaxial cable 4' when coaxial cable 4' is mated with male plug 902 via second fastener type 940. More specifically, coaxial-to-coaxial interface 478 and female-type screw-on type connector 398', described above in connection with FIG. 14*d,* are utilized to connect pin 906 and shield 908 with conductive core 90' and shield 94' of coaxial cable 4'. As discussed above in connection with FIG. 14*d,* coaxial-to-coaxial interface 478 includes conductive external male threads 480 and 482 adjacent opposite ends thereof, an axial conductive cylinder 484 and an insulating jacket 486 between conductive cylinder 484 and external male threads 480 and 482. External male threads 480 are configured to mate with internal female threads 942 of second fastener type 940 of plug body 904, and external male threads 482 are configured to mate with internal female threads 396' of female-type screw-on type connector 398'. When external male threads 480 and internal female threads 942 of second fastener type 940 are mated, third section 936 of pin 906 is received in one end of conductive cylinder 484. Similarly, when external male threads 482 are mated with internal female threads 396', conductive core 90' of coaxial cable 4' is received in the other end of conductive cylinder 484. Electrical continuity is established between shield 94' of coaxial cable 4' and shield 908 of male plug 902 via collar 400', female-type screw-on type connector 398', external male threads 480 and 482, and an edge 944 of shield 908 adjacent the mouth of second cavity 920. More specifically, edge 944 of shield 908 is configured to contact external male threads 480 when external male threads 480 are threadedly mated with internal female threads 942 of second fastener type 940.

With reference back to FIG. 14*a*, and with ongoing reference to FIG. 21, neck 910 of male plug 902 is configured to be received through the mouth of second cavity 470 of female housing 304. Clip 474 has a plurality of fingers 490 which extend in spaced relation toward the mouth of second cavity 470. Fingers 490 are configured to receive and grip first section 930 of pin 906 when neck 910 of male plug 902 is received in second cavity 470. Conductive tabs 492 of shield 424 contact one or both sides of shield 908 covering the sides of neck 910 when neck 910 of male plug 902 is received in second cavity 470 of female housing 304.

Figure 22:
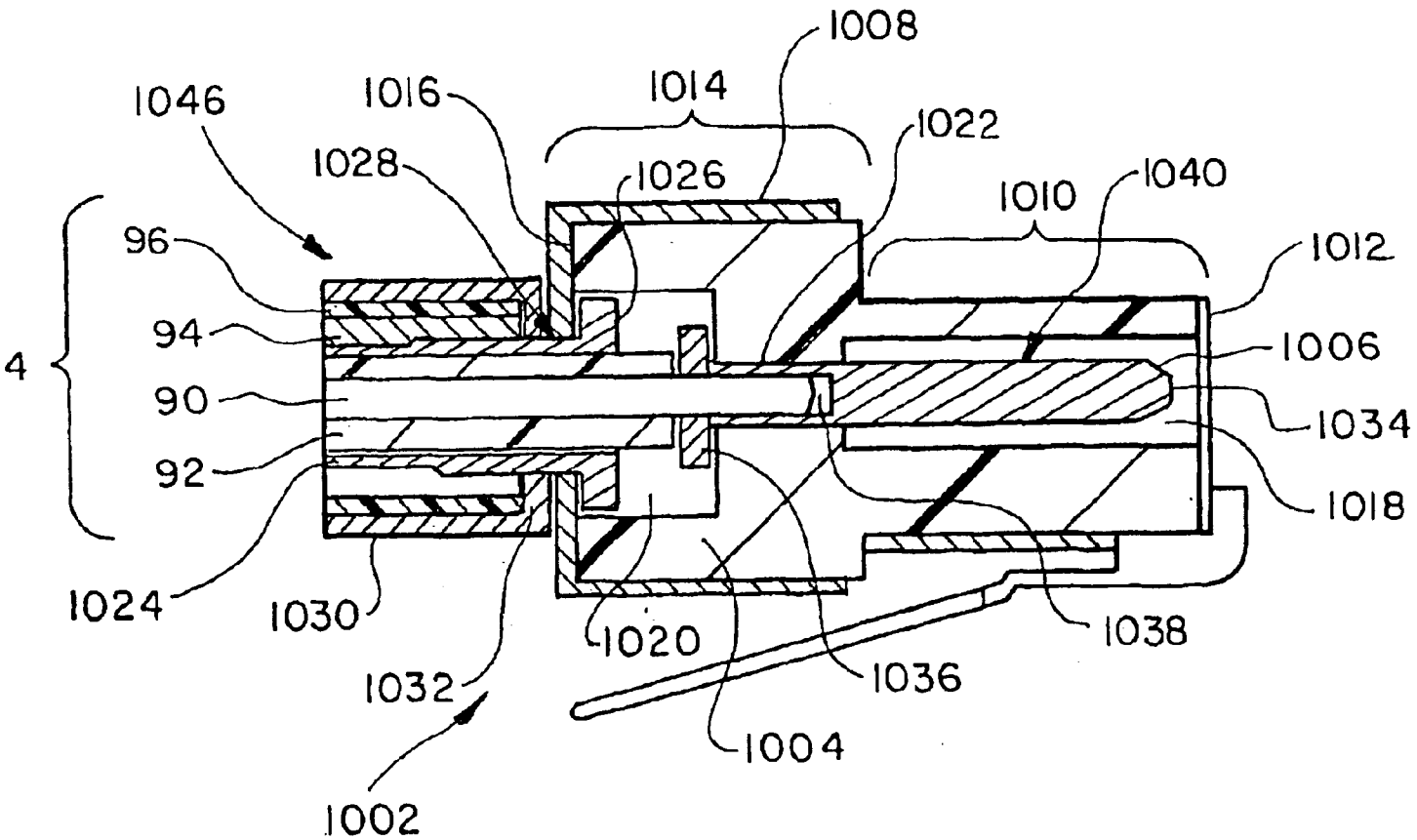
FIG. 22 is a sectional side view of a male plug in accordance with another embodiment of the invention connected to a coaxial cable.

With reference to FIG. 22, another embodiment of RJ type coaxial cable connector 2 includes a male plug 1002 having an insulating plug body 1004, a conductive pin 1006 and a conductive shield 1008. Plug body 1004 includes a neck 1010 adjacent a distal end 1012, and abase 1014 adjacent a proximal end 1016. Plug body 1004 includes a first cavity 1018 formed in neck 1010 adjacent distal end 1012 and a second cavity 1020 in base 1014 adjacent proximal end 1016. Between first cavity 1018 and second cavity 1020, plug body 1004 includes a bore 1022. Pin 1006 includes a tip 1034 and a head 1036 at opposite ends thereof. Pin 1006 also includes an axial bore 1038 which extends from head 1036 toward tip 1034.

Tip 1034 of pin 1006 is inserted throughbore 1022 so that a section 1040 of pin 1006 adjacent tip 1034 is received in first cavity 1018, and head 1036 is received in second cavity 1020 abutting the wall of plug body 1004 surrounding bore 1022.

Shield 1008 is preferably configured to cover the side, bottom and back surfaces of plug body 1004, and to cover the top surface of base 1014. Since neck 1010 is configured to be received in a mating cavity, e.g., 470, of an RJ type female housing, e.g., 304, having a shield, e.g., 424, thereabout, shield 1008 preferably does not cover the top surface of neck 1010.

Male plug 1002 includes a conductive sleeve 1024 having adjacent one end thereof an outwardly extending flange 1026. The body of sleeve 1024 is configured to be received between insulating jacket 92 and conductive shield 94 of coaxial cable 4. Preferably, when sleeve 1024 is received between insulating jacket 92 and conductive shield 94, flange 1026 is spaced from the terminal ends of insulating jacket 92 and conductive shield 94.

A conductive sleeve 1030 is received around insulating sheath 96. Sleeve 1030 includes an inwardly extending flange 1032 which terminates abutting the body of sleeve 1024 adjacent the terminal ends of conductive shield 94 and insulating sheath 96. The exposed end of conductive core 90 is received in axial bore 1038 with the terminal end of insulating jacket 92 abutting the side of head 1036 opposite tip 1034. The portion of shield 1008 covering the back of plug body 1004 adjacent proximal end 1016 includes a circular receiving aperture 1028 configured to frictionally receive the body of sleeve 1024 therethrough. The portion of shield 1008 surrounding receiving aperture 1028 is sandwiched between the inwardly extending flange 1032 of sleeve 1030 and the outwardly extending flange 1026 of sleeve 1024 when the body of sleeve 1024 is received in and frictionally engages the inside diameter of receiving aperture 1028. When male plug 1002 is assembled, flange 1026 is received in second cavity 1020 with the side of flange 1026 adjacent the body of sleeve 1024 abutting an inside surface of shield 1008 adjacent receiving aperture 1028, flange 1032 of sleeve 1030 abuts the body of sleeve 1024 and the outside surface of shield 1008 adjacent receiving aperture 1028, and the exposed end of conductive core 90 is received in axial bore 1038 with the terminal end of insulating jacket 92 abutting head 1036 of pin 1006. Prior to inserting pin 1006 into bore 1022, the exposed end of conductive core 90 is received in axial bore 1038 and the body of pin 1006 adjacent axial bore 1038 is crimped to the exposed end of conductive core 90. This crimping avoids withdrawal of conductive core 90 from axial bore 1038.

Prior to using male plug 1002, the body of sleeve 1030 is crimped to insulating sheath 96 of coaxial cable 4 and flange 1032 is crimped to the body of sleeve 1024. The crimping of the body of sleeve 1030 and flange 1032 to insulating sheath 96 and the body of sleeve 1024, respectively, forms yet another, e.g., third fastener type 1046, i.e., a crimp fastener.

The frictional interaction between the inside diameter of receiving aperture 1028 and the body of sleeve 1024 is selected so that shield 1008 and plug body 1004 are rotatable around the axis of sleeve 1024 while maintaining electrical contact between shield 1008 and sleeve 1024. In addition, the exposed end of conductive core 90 is frictionally received in axial bore 1038 so that conductive core 90 can rotate in axial bore 1038 while maintaining electrical contact therewith.

Figure 23:
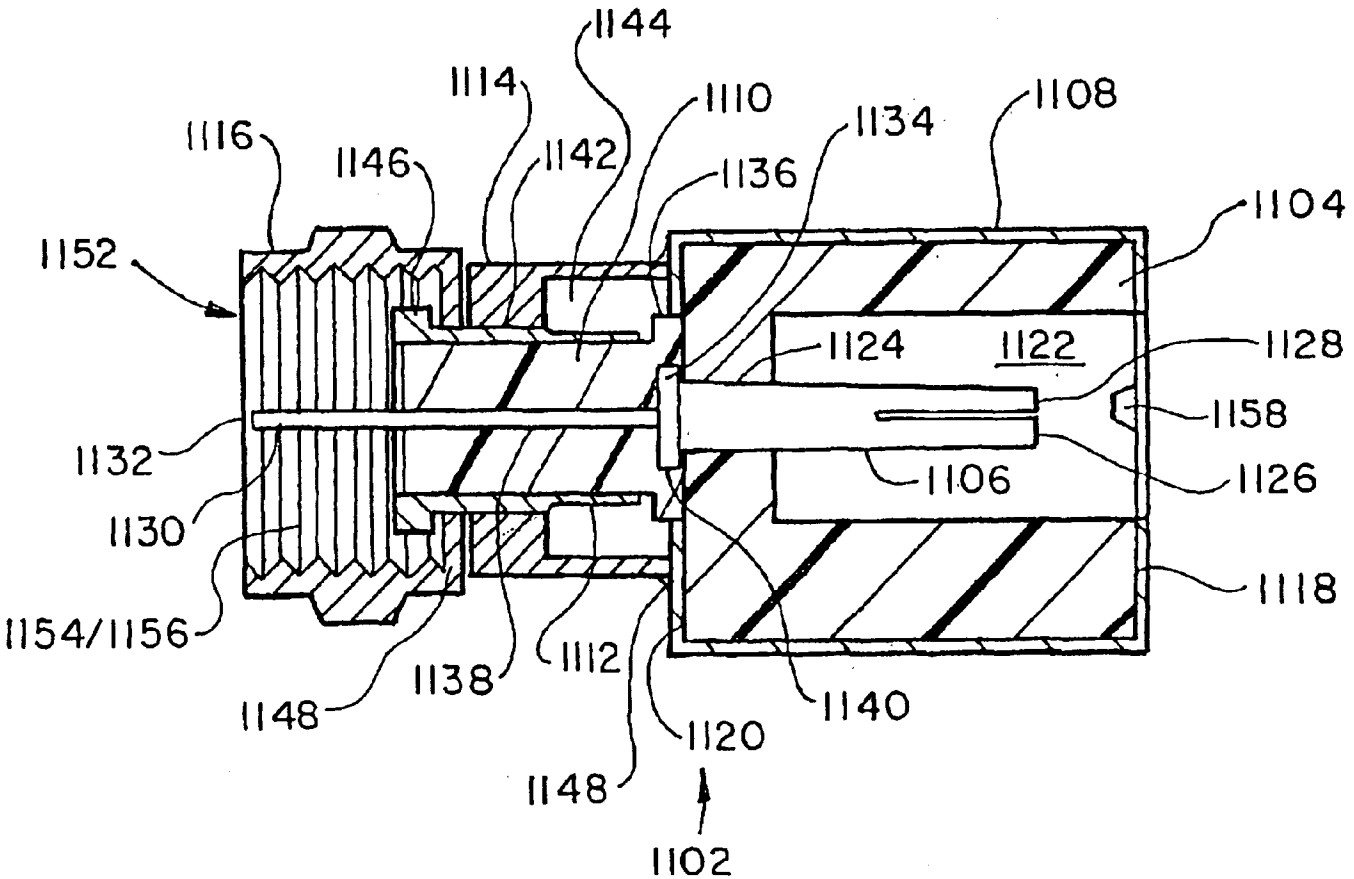
FIG. 23 is a cross-sectional side view of a female housing in accordance with another embodiment of the present invention.

With reference to FIG. 23, another embodiment of RJ type coaxial cable connector 2 includes female housing 1102 having an insulating housing body 1104, a conductive pin 1106, a conductive shield 1108, a flanged insulating sleeve 1110, a conductive sleeve 1112, a conductive collar 1114 and an internally threaded female-type screw-on type connector 1116.

Housing body 1104 has a distal end 1118, a proximal end 1120 and a cavity 1122 formed in housing body 1104 adjacent distal end 1118. Extending between cavity 1122 and proximal end 1120, housing body 1104 includes a bore 1124.

Pin 1106 includes a clip 1126 at a first end 1128 thereof, an elongated conductor 1130 adjacent a second end 1132 thereof and a flange 1134 therebetween. The body of pin 1106 between flange 1134 and first end 1128 is configured to frictionally interact with the wall of bore 1124 when inserted therein. Pin 1106 is configured so that clip 1126 is received in cavity 1122 when flange 1134 abuts proximal end 1120 of housing body 1104 around bore 1124.

Shield 1108 covers the top, sides, bottom and part of proximal end 1120 of housing body 1104. In addition, shield 1108 covers distal end 1118 of housing body 1104 surrounding the mouth of cavity 1122.

Sleeve 1110 includes a flange 1136 adjacent one end thereof and an axial bore 1138 having adjacent flange 1136 a countersink 1140. Sleeve 1110 is fitted on pin 1106 by inserting elongated conductor 1130 into bore 1138 so that flange 1136 abuts proximal end 1120 of housing body 1104 and flange 1134 is received in countersink 1140.

Collar 1114 includes a central aperture 1142 adjacent one end thereof and a cylindrical cavity 1144 adjacent the other end thereof. Sleeve 1112 has adjacent one end thereof an outwardly extending flange 1146. The end of collar 1114 adjacent cavity 1144 is secured to shield 1108 adjacent proximal end 1120 of conductive housing 1104 via, for example, solder, welding and the like, with the body of insulating sleeve 1110 received in central aperture 1142 of collar 1114. The end of sleeve 1112 opposite flange 1146 is inserted into a circular gap between the body of sleeve 1110 and the wall of collar 1114 defining central aperture 1142. More specifically, the body of sleeve 1112 is press fit into the space between collar 1114 and sleeve 1110.

Prior to press fitting the body of sleeve 1112 into the space between collar 1114 and sleeve 1110, internally threaded female-type screw-on type connector 1116 is received on the body of sleeve 1112. More specifically, internally threaded female-type screw-on type connector 1116 includes adjacent one end thereof an internally extending ring-like flange 1148 in which the body of sleeve 1112 is received with flange 1146 received in a cavity 1152 defined by the cylindrical wall 1150 of internally threaded female-type screw-on type connector 1116. Internally threaded female-type screw-on type connector 1116 defines a second fastener type 1154 having internal female threads 1156.

The press fit of sleeve 1112 between collar 1114 and sleeve 1110 avoids rotational or longitudinal movement of sleeve 1112 relative to collar 1114. Ring-like flange 1148 frictionally engages the body of sleeve 1112 so as to permit internally threaded female-type screw-on type connector 1116 to rotate on the body of sleeve 1112 while remaining in electrical contact therewith. To avoid unnecessarily restricting the rotational motion of internally threaded female-type screw-on type connector 1116 around sleeve 1112, sleeve 1112 is press fit between collar 1114 and sleeve 1110 with flange 1146 spaced from the end of collar 1114 opposite cavity 1144 sufficiently to loosely receive flange 1148 therebetween.

With continuing reference to FIG. 23, and with reference back to FIG. 14*d*, female housing 1102 can be utilized in place of female housing 304 shown in FIG. 14*d* to connect to coaxial cable 4' via coaxial-to-coaxial interface 478. Female housing 1102 includes tabs 1158 which extend into cavity 1122 for contacting a shield, e.g., shield 328, covering the sides of male plug 302 in FIG. 14*a* when neck 378 of male plug 302 is inserted into cavity 1122 of female housing 1102.

As can be seen, the present invention provides a coaxial cable connector, preferably an RJ type coaxial cable connector, which can be easily removably connected between a pair of coaxial cables or between a coaxial cable and a PCB while providing electromagnetic shielding of the signal conveyed on the core of the coaxial cable(s).

Figure 20:
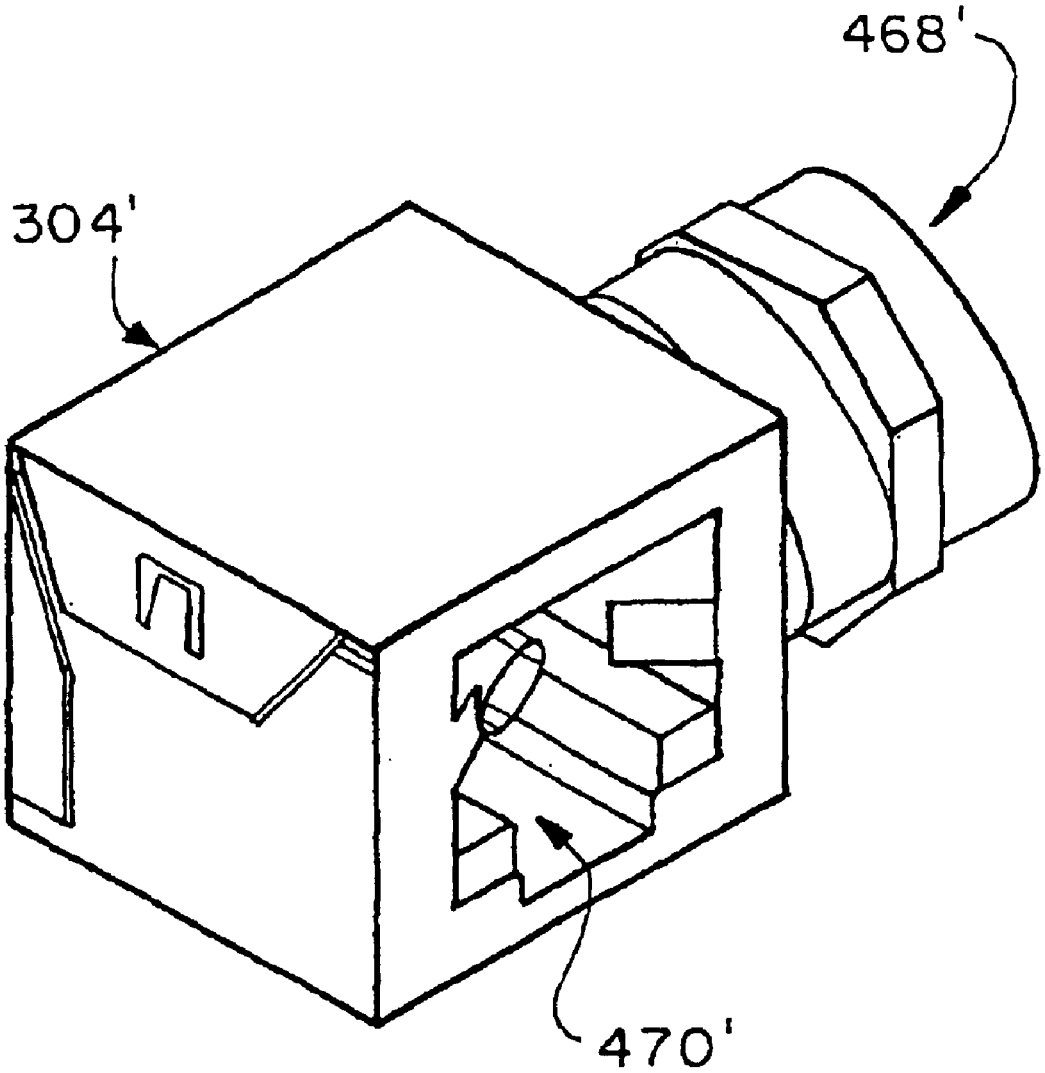
FIG. 20 is a perspective view of a variant of the female housing in FIG. 14*a;*

The present invention has been described with reference to the preferred embodiments. Obvious modifications and alterations will occur to others upon reading and understanding the preceding detailed description. For example, in FIG. 14*a*, female housing 304 is shown as having a mouth of first cavity 468 and a mouth of second cavity 470 at opposite ends thereof. However, as shown in FIG. 20, a female housing 304' can include a first cavity 468' having a mouth which is transverse, e.g., perpendicular, to a mouth of a second cavity 470'. Similar comments apply in respect of the female housings shown in FIGS. 16, 17 and 19 as well as to the male plugs shown in FIGS. 14, 15 and 18. In addition, while the female housings shown in FIGS. 6, 7, 13, 16 and 17 are configured for mounting to through-holes in printed circuit boards, these housings could also be configured in a manner known in the art for surface mounting to printed circuit boards. It is intended that the invention be construed as including all such modifications and alterations insofar as they come within the scope of the appended claims or the equivalents thereof.

I claim:

1. A coaxial cable connector comprising an RJ type male plug having a first cavity and a second cavity, a first conductor received in the RJ type male plug, the first conductor having adjacent a first end thereof a first section received within the first cavity of the RJ type male plug, the first conductor having adjacent a second end thereof a second section received within the second cavity of the RJ type male plug, the part of the RJ type male plug surrounding at least part of the first cavity having the form of a first fastener type, the first section of the first conductor configured to electrically contact a central conductor of a first coaxial cable when the first coaxial cable is mated with the RJ type male plug via the first fastener type.

2. The coaxial cable connector as set forth in claim 1, wherein:

the first section of the first conductor is in the form of a pin having a proximal end received in the RJ type male plug and a distal end received in the first cavity of the RJ type male plug; and the second section of the first conductor is in the form of a clip having a proximal end received in the RJ type male plug and connected to the proximal end of the pin, and a distal end received in the second cavity of the RJ type male plug and configured to receive the central conductor of the first coaxial cable when the first coaxial cable is mated with the RJ type male plug via the first fastener type.

3. The coaxial cable connector as set forth in claim 1, further including a first shield covering at least part of the first cavity of the RJ type male plug and electrically isolated from the first conductor, the first shield configured to be electrically connected with a shield of the first coaxial cable when the first coaxial cable is mated with the RJ type male plug via the first fastener type.

4. The coaxial cable connector as set forth in claim 1, further including an RJ type female housing having a first cavity and a second cavity, a second conductor received in the RJ type female housing, the second conductor having adjacent a first end thereof a first section received within the first cavity of the RJ type female housing, the second conductor having adjacent a second end thereof a second section received within the second cavity of the RJ type female housing, the part of the RJ type female housing surrounding at least part of the first cavity having the form of a second fastener type, the first section of the second conductor configured to be electrically connected with a central conductor of a second coaxial cable when the second coaxial cable is mated with the RJ type female housing via the second fastener type, wherein the RJ type male plug adjacent the second cavity thereof is configured to be received in the second cavity of the RJ type female housing with the second end of the first conductor electrically contacting the second end of the second conductor.

5. The coaxial cable connector as set forth in claim 4, wherein:

the first section of the second conductor is in the form of a pin having a proximal end received in the RJ type female housing and a distal end received in the first cavity of the RJ type female housing; and the second section of the second conductor is in the form of a clip having a proximal end received in the RJ type female housing and connected to the proximal end of the pin, and a distal end received in the second cavity of the RJ type female housing.

6. The coaxial cable connector as set forth in claim 4, further including:

a first shield covering at least part of the first cavity of the RJ type male plug and electrically isolated from the first conductor, the first shield configured to be electrically connected with a shield of the first coaxial cable when the first coaxial cable is mated with the RJ type male plug via the first fastener type; and a second shield covering at least part of the first cavity of the RJ type female housing and electrically isolated from the second conductor, the second shield configured to be electrically connected with a shield of the second coaxial cable when the second coaxial cable is mated with the RJ type female housing via the second fastener type, wherein the first shield of the first coaxial cable and the second shield of the second coaxial cable are electrically connected when the RJ type male plug adjacent the second cavity of the RJ type male plug is received in the second cavity of the RJ type female housing.

7. The coaxial cable connector as set forth in claim 4, wherein:

the first fastener type has one of external male threads and internal female threads; and the second fastener type has the other of external male threads and internal female threads.

8. The coaxial cable connector as set forth in claim 7, wherein the second fastener type is rotatable relative to the remainder of the RJ type female housing.

9. The coaxial cable connector as set forth in claim 4, wherein:

the first conductor includes a clip at the first end thereof and a pin at the second end thereof; and the second conductor includes a pin at the first end thereof and a clip at the second end thereof, wherein:

the clip at the second end of the second conductor is configured to mate with and grip the pin at the second end of the first conductor;

the clip at the first end of the first conductor is configured to mate with and grip the central conductor of the first coaxial cable; and the wire at the first end of the second conductor is configured to mate with a receiving cylinder of an interface means connected between the second coaxial cable and the second fastener type.

10. A coaxial cable connector comprising an RJ type female housing having a first cavity and a second cavity, a conductor received in the RJ type female housing, the conductor having adjacent a first end thereof a first section received within the first cavity of the RJ type female housing, the conductor having adjacent a second end thereof a second section received within the second cavity of the RJ type female housing, the part of the RJ type female housing surrounding at least part of the first cavity having the form of a fastener, the first section of the conductor configured to be electrically connected with a central conductor of a coaxial cable when the coaxial cable is mated with the RJ type female housing via the fastener.

11. The coaxial cable connector as set forth in claim 10, further including a shield covering at least part of the first cavity of the RJ type female housing and electrically isolated from the conductor, the shield configured to be electrically connected with a shield of the coaxial cable when the coaxial cable is mated with the RJ type female housing via the fastener.

12. A coaxial cable connector comprising:

an RJ type plug body having a first cavity configured to receive a first coaxial cable therein and a second cavity; and a first conductor having a first end secured in the RJ type plug body and a second end received within the second cavity of the RJ type plug body, the first conductor having a bore which extends from the first end toward the second end, the bore in communication with the first cavity, the bore configured to receive a central conductor of the first coaxial cable when the first coaxial cable is received in the first cavity.

13. The coaxial cable connector as set forth in claim 12, further including a first shield covering at least part of the first cavity of the RJ type plug body and electrically isolated from the first conductor, the first shield configured to electrically contact a shield of the first coaxial cable when the first coaxial cable is received in the first cavity.

14. The coaxial cable connector as set forth in claim 12, further including means for electrically connecting the first shield and the shield of the first coaxial cable, the means for electrically connecting configured so that the first shield can rotate at least partially around an axis of the first coaxial cable while maintaining electrical contact between the shield of the first coaxial cable and the first shield.

15. The coaxial cable connector as set forth in claim 12, further comprising an RJ type housing body including a second conductor secured in the RJ type housing body with one end of the second conductor received in a cavity of the RJ type housing body, the cavity of the RJ type housing body configured to receive therein the end of the RJ type plug body adjacent the second cavity thereof, the second conductor adjacent the one end thereof configured to electrically contact the first conductor adjacent the second end thereof when the end of the RJ type plug body adjacent the second cavity is received in the cavity of the RJ type housing body.

16. The coaxial cable connector as set forth in claim 15 further including:

a first shield covering at least part of the first cavity of the RJ type plug body and electrically isolated from the first conductor, the first shield configured to electrically contact a shield of the first coaxial cable when the first coaxial cable is received in the first cavity, and a second shield covering at least part of the cavity of the RJ type housing body and electrically isolated from the second conductor, wherein the first shield of the first coaxial cable and the second shield of the second coaxial cable electrically contact when the RJ type plug body adjacent the second cavity is received in the cavity of the RJ type housing body.

17. The coaxial cable connector as set forth in claim 15, wherein the second conductor adjacent the one end thereof is in the form of a clip configured to mate with and grip the first conductor adjacent the second end thereof when the end of the RJ type plug body adjacent the second cavity is received in the cavity of the RJ type housing body.

18. The coaxial cable connector as set forth in claim 15, wherein the second conductor includes another end which projects out of the RJ type housing body for electrical connection with an electrically conductive trace disposed on a printed circuit board.

19. The coaxial cable connector as set forth in claim 15, wherein the second conductor includes another end which is electrically connected to a first printed circuit board received in the RJ type housing body, and the RJ type housing body includes a conductive pin electrically connected to the second conductor via a conductive trace disposed on the first printed circuit board, the conductive pin projecting out of the housing body for electrical connection with a conductive trace disposed on a second printed circuit board.

20. A coaxial cable connector comprising:

an RJ type housing body having a cavity therein; and a conductor secured in the RJ type housing body with one end of the conductor received in the cavity, the conductor adjacent the one end being in the form a clip for receiving and gripping an end of a pin received in a cavity of an RJ type plug body when the RJ type plug body adjacent the cavity thereof is received in the cavity of the RJ type housing body.

21. The coaxial cable connector as set forth in claim 20, wherein:

the other end of the conductor is in the form of a clip for receiving and gripping a central conductor of a coaxial cable; and the RJ type housing body includes a cover configured to coact with the RJ type housing body for receiving the other end of the conductor and the coaxial cable therebetween when the cover is secured to the housing body.

22. The coaxial cable connector as set forth in claim 21, further including a shield having a first part at least partially covering the cavity of the RJ type housing body and a second part received between the housing body and the cover when the cover is secured to the housing body, wherein the shield is electrically isolated from the conductor and electrically contacts a shield of the coaxial cable when the cover is secured to the housing body with the coaxial cable therebetween.

23. A coaxial cable connector comprising:

an RJ type plug body having a cavity;

a cylinder connected to the RJ type plug body, the cylinder having a bore therethrough in communication with the cavity of the RJ type plug body;

a conductor received in the bore of the cylinder, one end of the conductor in the form a pin received in the cavity of the RJ type plug body, the other end of the conductor in the form of a clip configured to mate with a central conductor of a coaxial cable; and a plurality of housing parts configured to be mated together with the cylinder and the coaxial cable therebetween when the central conductor of the coaxial cable is mated with the clip of the conductor.

24. The coaxial cable connector as set forth in claim 23, further including:

a shield covering at least part of the RJ type plug body, and means for electrically connecting the shield covering the at least part of the RJ type plug body and a shield of the coaxial cable, the means for electrically connecting received between the mated housing parts.

25. The coaxial cable connector as set forth in claim 24, wherein the means for electrically connecting includes one or more conductive contacts received between the mated housing parts, each contact extending between the shield covering the at least part of the RJ type plug and the shield of the coaxial cable.

26. The coaxial cable connector as set forth in claim 24, wherein the RJ type plug body and the shield covering the at least part of the RJ type plug body are rotatable relative to the coaxial cable and the mated housing parts around an axis of the bore of the cylinder.

27. A coaxial cable connector comprising:

an RJ type housing configured to mate with a first coaxial cable having a central conductor in spaced coaxial relation with a conductive sheath, the RJ type housing having a conductor received therein and a shield in spaced relation covering at least part of the conductor of the RJ type housing, the conductor and the shield of the RJ type housing electrically contacting the central conductor and conductive sheath, respectively, of the first coaxial cable when the RJ type housing and the first coaxial cable are mated; and an RJ type plug configured to mate with a second coaxial cable having a central conductor in spaced coaxial relation with a conductive sheath, the RJ type plug having a conductor received therein and a shield in spaced relation covering at least part of the conductor of the RJ type plug, the conductor and the shield of the RJ type plug electrically contacting the central conductor and conductive sheath of the second coaxial cable, respectively, when the RJ type plug and the second coaxial cable are mated, wherein:

the RJ type housing has a cavity configured to receive a part of the RJ type plug therein; and the conductor and shield of the RJ type housing electrically contact the conductor and shield of the RJ type plug when the part of the RJ type plug is received in the cavity of the RJ type housing.

28. An RJ type female connector comprising a housing configured to mate with a first coaxial cable having a conductive shield in spaced coaxial relation with a conductive core, the RJ type female connector having a plug receiving opening configured to receive and mate with an RJ type male connector which is configured to mate with a second coaxial cable having a conductive shield in spaced coaxial relation with a conductive core, the RJ type female connector and the RJ type male connector each having a conductor received therein and a conductive shield covering at least part of the conductor, the conductor and the conductive shield of each of the RJ type female connector and the RJ type male connector electrically connected with the conductive core and conductive shield of the first coaxial cable and the second coaxial cable when the RJ type female connector and the RJ type male connector are mated with the first coaxial cable and the second coaxial cable, respectively, whereby conductivity is established between the conductive cores and the conductive shields of the first and second coaxial cables when the RJ type male connector is received in the plug receiving opening of the RJ type female connector.

* * * * *

UNITED STATES PATENT AND TRADEMARK OFFICE

CERTIFICATE OF CORRECTION

PATENT NO. : 6,786,757 B2
DATED : September 7, 2004
INVENTOR(S) : Pocrass

It is certified that error appears in the above-identified patent and that said Letters Patent is hereby corrected as shown below:

Column 27,
Line 35, “form a clip” should read -- form of a clip --
Line 65, “form a pin” should read -- form of a pin --

Signed and Sealed this

Twelfth Day of April, 2005

JON W. DUDAS
*Director of the United States Patent and Trademark Office*